US010786963B2

(12) United States Patent
Gamlen et al.

(10) Patent No.: US 10,786,963 B2
(45) Date of Patent: Sep. 29, 2020

(54) TABLET MANUFACTURE

(71) Applicant: Gamlen Tableting Limited, Nottingham (GB)

(72) Inventors: Michael John Desmond Gamlen, Nottingham (GB); Joseph Charles Domingue, Laguna Niguel, CA (US); Henry David Kafeman, Milton Keynes (GB)

(73) Assignee: GAMLEN TABLETING LIMITED, Nottingham (GB)

( * ) Notice: Subject to any disclaimer, the term of this patent is extended or adjusted under 35 U.S.C. 154(b) by 197 days.

(21) Appl. No.: 15/770,194

(22) PCT Filed: Oct. 21, 2016

(86) PCT No.: PCT/GB2016/053309
§ 371 (c)(1),
(2) Date: Apr. 21, 2018

(87) PCT Pub. No.: WO2017/068375
PCT Pub. Date: Apr. 27, 2017

(65) Prior Publication Data

US 2018/0304569 A1 Oct. 25, 2018

(30) Foreign Application Priority Data

Oct. 23, 2015 (GB) ..... 1518842.8
Apr. 7, 2016 (GB) ..... 1605939.6

(51) Int. Cl.
*B30B 15/32* (2006.01)
*B30B 11/04* (2006.01)
(Continued)

(52) U.S. Cl.
CPC ..... *B30B 15/32* (2013.01); *A61J 3/10* (2013.01); *B30B 1/18* (2013.01); *B30B 11/04* (2013.01);
(Continued)

(58) Field of Classification Search
None
See application file for complete search history.

(56) References Cited

U.S. PATENT DOCUMENTS 2,214,505 A * 9/1940 Magnenat ..... B30B 11/04 425/200
3,775,032 A * 11/1973 Smith ..... B30B 11/02 425/78
(Continued)

FOREIGN PATENT DOCUMENTS

DE 4310130 7/2001
EP 2123435 11/2009
(Continued)

OTHER PUBLICATIONS

Great Britain Patent Application No. 1605939.6, Search Report dated Oct. 7, 2016, 5 pages.
(Continued)

*Primary Examiner* — Mary Lynn F Theisen
(74) *Attorney, Agent, or Firm* — Leber IP Law; Celia H. Leber

(57) ABSTRACT

The invention relates to improvements in tablet manufacturing, particularly in the small scale/bespoke manufacture of tablets. The application describes the mechanism of a motor driven tablet press (10) with biasing means (222) and wherein the angular position of the motor (28) is controllable, the inclusion of load cells (26,234), an improved die
(Continued)

mounting (100,300) and die assembly (36'), and improved compaction methods including controlled pauses (75,90) during tablet forming.

58 Claims, 13 Drawing Sheets

(51) Int. Cl.

| | |
|---|---|
| ***B30B 15/02*** | (2006.01) |
| ***A61J 3/10*** | (2006.01) |
| ***B30B 15/00*** | (2006.01) |
| ***B30B 11/10*** | (2006.01) |
| ***B30B 1/18*** | (2006.01) |

(52) U.S. Cl.
CPC ..... *B30B 11/10* (2013.01); *B30B 15/0094* (2013.01); *B30B 15/022* (2013.01)

(56) References Cited

U.S. PATENT DOCUMENTS

| | | | |
|---|---|---|---|
| 4,751,411 | A | 6/1988 | Fukaya et al. |
| 5,027,671 | A | 7/1991 | Erikson et al. |
| 5,829,347 | A | 11/1998 | Hiruma |
| 6,499,369 | B1 | 12/2002 | Piotrowski et al. |
| 8,668,483 | B2 | 3/2014 | Mercado et al. |
| 9,440,381 | B1 * | 9/2016 | Shaham ..... B30B 15/065 |

FOREIGN PATENT DOCUMENTS

| | | |
|---|---|---|
| GB | 2489658 | 10/2012 |
| JP | S6427795 | 1/1989 |
| JP | H0557498 | 3/1993 |
| JP | 2001124174 | 5/2001 |
| JP | 2008266752 | 6/2008 |
| WO | 2014001805 | 1/2014 |

OTHER PUBLICATIONS

Great Britain Patent Application No. 1605939.6, Search Report dated Apr. 18, 2017, 3 pages.
International Patent Application No. PCT/GB2016/053309, International Search Report dated Mar. 13, 2017.
International Patent Application No. PCT/GB2016/053309, Written Opinion, dated Mar. 13, 2017.

* cited by examiner

TABLET MANUFACTURE

RELATED APPLICATIONS

This application is a national phase entry of International Patent Application No. PCT/GB2016/053309, filed Oct. 21, 2016, which claims the benefit under 35 U.S.C. § 119(b) to Great Britain Patent Application No. 1518842.8, filed Oct. 23, 2015 and Great Britain Patent Application No. 1605939.6, filed Apr. 7, 2016, the entire contents of which are hereby incorporated by reference.

The present invention relates to improvements in tablet manufacturing. In particular, the invention relates to a device for small scale/bespoke manufacture of tablets.

The large-scale production of tablets typically involves the use of tablet punches which operate to compact a volume of powder located in a die. The powder in the die is held between opposing punches which move together by a predetermined distance of travel to produce a tablet of controlled thickness within a die of known geometry. This is such that the formed tablet has a known or determinable density according to the die geometry and volume of powder used but there is no direct control of the force applied to the tablet during the compaction process.

The required volume of powder and/or degree and force of compression to achieve a desired result will vary depending on the formulation being used. An iterative approach to tablet production and testing is generally needed in order to converge on a satisfactory tablet formulation and corresponding compaction process. Research into tablet formulations and production processes requires relatively small scale production and testing of tablets.

Known bespoke tablet machines for small scale tablet production and testing of tablets are known. One such device comprises a linearly actuated press member which is connected to a load cell. The press member can be used to compact powder held in a tablet chamber of a die assembly, and the tablet press can measure and record the forces detected by the load sensor during the compaction process. The same press member may also be used to eject a tablet from the die assembly, again with the tablet press measuring and recording the forces during the operation (the 'ejection' forces). This information about the tablet properties is of great value in correctly configuring machines for mass production of tablets, or for fine tuning formulations.

The known tablet press does, however, suffer certain drawbacks.

For example, before the tablet can be ejected a part of the die assembly has to be moved from a first position, in which it forms a solid floor of the tablet chamber, to a second position where it where it provides an opening for the ejection of a tablet. This operation, which minimises the required complexity of the tablet press, is typically performed by hand, which can complicate the operation and potentially contaminate the tablet.

The compaction of the powder in the chamber also creates some adhesion between the tablet/powder and the interior of the die assembly. This results in dissipation of compression forces at the internal side walls of the die during the compression process, leading to inaccuracies in the measurement of forces applied to the powder during compression. The magnitude of the error/inaccuracy is not determined in known devices, and will vary depending on the particular powder composition and compaction parameters. Without this information, a compensation factor cannot be reliably applied. The missing information would also be useful in fully understanding the behaviour of the powder during compaction.

Adhesion can also occur between the formed tablet and the floor of the die assembly. This force required to overcome this adhesion (the detachment force) can be fairly high, perhaps 30 kg or more, potentially causing difficulty to an operator. In addition, useful information concerning the detachment force for different tablet formulations and different compaction conditions is lost due to the manual operation.

It is an aim of the present invention to overcome the abovementioned drawbacks, while maintaining a relatively simple but precisely controllable tablet forming operation.

According to a first aspect of the invention there is provided a tablet press as defined in the appended claim 1. Further beneficial features of the tablet press are recited in the dependent claims.

The invention provides a tablet press with biasing means associated with the compaction mechanism ensure that play/slop within the mechanism is minimised. This helps to ensure that the position of the press member can be precisely and reliably controlled simply by controlling the motor to a defined angular position. Indeed, tolerance on the positional control has been found to be of the magnitude of 0.1 μm. This avoids the need for separate position sensors to measure the position of the press member directly.

At least one further position of the press member may correspond to a further pre-set angular position of the motor stored in the controller or be determined based on the detection of a pre-set load by the load cell.

The compaction mechanism may comprise a fixed frame and support columns movable vertically relative to the fixed frame. Telescoping guards may be provided surrounding upper sections of the support columns that extend beyond the base to avoid contaminants, such as powder, entering the mechanism.

The mechanism may further comprise a ball screw which moves a horizontal member attached between a pair of support columns when a threaded rod of the ball screw is rotated by the motor. The resilient means, for example coil springs, may then be provided between the horizontal member and a part of the fixed frame and/or a block may be provided on the horizontal member to engage one or more limit switches attached to the frame.

The tablet press may also comprise a second load cell located below the die assembly. The provision of a second load cell below the die assembly allows for a comparison of the forces experienced at the top and bottom of a column of powder in the die during compression to provide additional information about the behaviour of the powder during tablet formation.

The second load cell may extend upwards from the base of the tablet press and the die assembly may comprise a die floor with a vertically movable portion which rests, in use, on top of the second load cell.

The die floor may comprise a slider block with an opening spaced from the vertically movable portion such that the die floor can be moved to position either the opening or the vertically movable portion beneath a chamber of the die, for example to allow ejection of a tablet, once formed, from the die.

The vertically movable portion may comprise a disc, held in place within the remainder of the die floor by a ball spring screw.

At least one further position of the press member may be determined based on the detection of a pre-set load by the second load cell.

The controller of the tablet press may monitor a limit value during a compaction operation and stop the motor to hold the mechanism at a fixed location for a defined period of time when the limit value is reached.

The period of time may be pre-set as an absolute value or may be a function of the speed of the motor during the compaction operation. This allows simulation of the operation of a number of different commercial scale tablet presses with different operational characteristics The limit value may be a position of the press indicative of the end of a desired compaction operation, which may be achieved by the controller moving the motor to a set angular position.

Alternatively, the limit value is a desired/target pressure at the end of a desired compaction operation and/or a desired intermediate value during a desired compaction operation.

Where an intermediate value is used, the controller may be configured to re-start the compaction operation after the period of time, possibly with the motor running at a second, different, speed. The second speed may be pre-set by a user prior to the compaction operation or may be determined based on load cell readings and positional information during the time period. The positional information may be obtained from a monitored angular position of the motor.

The motor may be stopped by the controller maintaining the motor in an energised state with the motor speed set to zero.

A further aspect of the present invention provides a pivotally mounted die assembly as described in appended claim 27. Further beneficial features are recited in the associated dependent claims.

The die assembly comprises a pivoting part mounted at a pivot to a supporting frame. The pivoting part comprises a die assembly with a chamber for forming a tablet. The chamber has an open end for receiving a linearly operating punch of a tablet press along an axis extending through the chamber, and a sliding floor component opposite the open end, which is movable substantially at right angles to the axis between first and second positions restraining means are provided to selectively stop rotation of the pivoting part at first and second defined angular positions relative to the supporting frame.

Providing a pivoting mounting allows the die assembly to be rotated between two set positions, so that the same linearly operating punch can engage with the die assembly from two different directions. In particular, a linearly operating punch of a tablet press capable of measuring compaction and ejection forces can be used to also move the sliding floor component once a tablet has been formed, and to measure forces involved in this operation. This beneficially provides information about the detachment force for a particular tablet formed in the die assembly.

The restraining means may comprise a fixed stop provided on the supporting frame, which may comprise two abutment surfaces for abutment with the pivoting part. For example, abutment surfaces may be provided to contact an upper surface of the pivoting part in two specific orientations.

The restraining means may further comprise one, two or more selectively engageable stop members. The or each selectively engageable stop member may also be provided on the supporting frame, and may comprises a blocking portion which is movable between a disengaged position and an engaged position, eg via a pivot to the surrounding frame. The or each selectively engageable stop member may also comprise a lever joined to the blocking portion for actuating the blocking portion.

The blocking portion of the or each selectively engageable stop member, in its engaged position, may provide an abutment surface such that the pivoting part of the assembly can be held between the fixed stop and the blocking part of a selectively engageable stop member.

One or more notches for receiving the blocking part of a selectively engageable stop member are provided on the pivoting part, for example in an upper surface or and end surface of the pivoting part. The engagement of said blocking part with a notch may hold the pivoting part at a further defined angular position.

Alternatively, the or each selectively engageable stop member may be provided on the pivoting part to engage with a notch, or one of a plurality of notches, provided on the supporting frame.

The restraining means may alternatively comprise a stepper motor controlled to hold the pivoting part at said first and second defined angular positions. The stepper motor may be additionally controlled to hold the pivoting part in at least one further angular position.

The at least one further angular position may be between said first and second angular positions.

The first and second angular positions are spaced apart by 90°. The third angular position may be, for example, at approximately 30°, 45° or 60° from the second angular position, either towards or away from the first angular position.

The pivot between the pivoting part and the supporting frame may intersect with the axis extending through the chamber, and with the sliding floor component.

The pivoting part may comprise a sloping floor or channel along which a tablet formed in the chamber can pass.

The sliding floor component may comprise an opening which is offset from the chamber when the sliding floor component is in its first position and is aligned with the chamber when the sliding floor component is in its second position. The sloping floor or channel may be part of a base plate below the chamber and the sliding floor component, or the sliding floor component comprises the sloping floor or channel.

The die assembly may be permanently fixed via the pivot to the supporting frame or the pivoting part may comprise a mounting part, such as a tray, for receiving the die assembly.

According to a further aspect of the invention there is provided a pivoting die mounting apparatus as described in appended claim 47. Further beneficial features are recited in the associated dependent claims.

The pivoting die mounting apparatus comprises a supporting frame and a pivoting part, for receiving a die assembly, mounted at a pivot to the supporting frame. The pivoting part is open at one end so as not to obstruct access to an end of the die assembly, and restraining means are provided to selectively stop rotation of the pivoting part at first and second defined angular positions relative to the supporting frame.

The benefits of the pivoting mounting are as previously described.

The restraining means may comprise a fixed stop provided on the supporting frame, which may comprise two abutment surfaces for abutment with the pivoting part. For example, abutment surfaces may be provided to contact an upper surface of the pivoting part in two specific orientations.

The restraining means may further comprise one, two or more selectively engageable stop members. The or each selectively engageable stop member may also be provided on the supporting frame, and may comprises a blocking portion which is movable between a disengaged position and an engaged position, eg via a pivot to the surrounding frame. The or each selectively engageable stop member may also comprise a lever joined to the blocking portion for actuating the blocking portion.

The blocking portion of the or each selectively engageable stop member, in its engaged position, may provide an abutment surface such that the pivoting part of the assembly can be held between the fixed stop and the blocking part of a selectively engageable stop member.

One or more notches for receiving the blocking part of a selectively engageable stop member are provided on the pivoting part, for example in an upper surface or and end surface of the pivoting part. The engagement of said blocking part with a notch may hold the pivoting part at a further defined angular position.

Alternatively, the or each selectively engageable stop member may be provided on the pivoting part to engage with a notch, or one of a plurality of notches, provided on the supporting frame.

The restraining means may alternatively comprise a stepper motor controlled to hold the pivoting part at said first and second defined angular positions. The stepper motor may be additionally controlled to hold the pivoting part in at least one further angular position.

The at least one further angular position may be between said first and second angular positions.

The first and second angular positions are spaced apart by 90°. The third angular position may be at, for example, approximately 30°, 45° or 60° from the second angular position, either towards or away from the first angular position.

The pivoting part may comprise a sloping floor or channel along which a tablet formed in the chamber can pass.

The invention also provides a method of forming a tablet as described in the appended claim 62. Further beneficial method steps are recited in the associated dependent claims.

The method comprises the following sequence of steps:

A) actuating the punch of a tablet press to compress powder contained in the chamber of a die assembly against a sliding floor component of the die assembly;

B) withdrawing the punch from the chamber;

C) rotating the die assembly from a first set angular position to a second set angular position; and D) actuating the punch of the tablet press to move the sliding floor component from a first position to a second position.

In the first angular position the tablet press, for example a vertically operating tablet press, can measure compaction forces applied by the punch in forming a tablet. In the second angular position, the same tablet press can measure the detachment force between the formed tablet and the sliding floor of the die assembly.

The method may comprise the additional steps of:

E) rotating the die assembly from said second set angular position to said first set angular position; and F) actuating the punch of the tablet press to eject a tablet from the chamber;

wherein steps E) and F) are performed in sequence after step D).

The additional steps allow the ejection force of a tablet to also be measured by the same tablet press.

The method may comprise the additional steps of:

G) rotating the die assembly to a third angular position; and

H) placing powder into the open end of the tablet forming chamber;

wherein steps G) and H) are performed in sequence before step A).

These additional steps allow for the rotation of the die assembly to provide clearance between an upper end of the die assembly and the punch of the tablet press to facilitate filling of the chamber The third angular position is between the first and second angular positions. The first and second angular positions are spaced apart by 90°, for example the first angular position may be a horizontal alignment of the die assembly, with the chamber of the die assembly vertically oriented to receive the punch from above, and the second angular position may align the die assembly vertically, allowing the slider block to be pushed at right angles to the chamber. The third angular position may be, for example, at approximately 30°, 45° or 60° from the second angular position, either towards or away from the first angular position.

The method may be performed using the pivotally mounted die assembly as previously described, or using the pivoting die mounting apparatus as previously described and a die assembly comprising a tablet forming chamber having an open end for receiving a linearly operating punch of the tablet press and a sliding floor component opposite the open end.

The various aspects of the invention variously provide improvements in the four main steps of tablet formation, namely filling the die, compacting the tablet, releasing the tablet and ejecting the tablet. As such, an improvement in the tabletting process is provided by each aspect individually, and an overall improvement is provided by the aspects in combination.

Wherever practicable, any of the essential or preferable features defined in relation to any one aspect of the invention may be applied to any further aspect. Accordingly, the invention may comprise various alternative configurations of the features defined above.

Practicable embodiments of the invention are described in further detail below by way of example only with reference to the accompanying drawings, of which:

Figure 1:
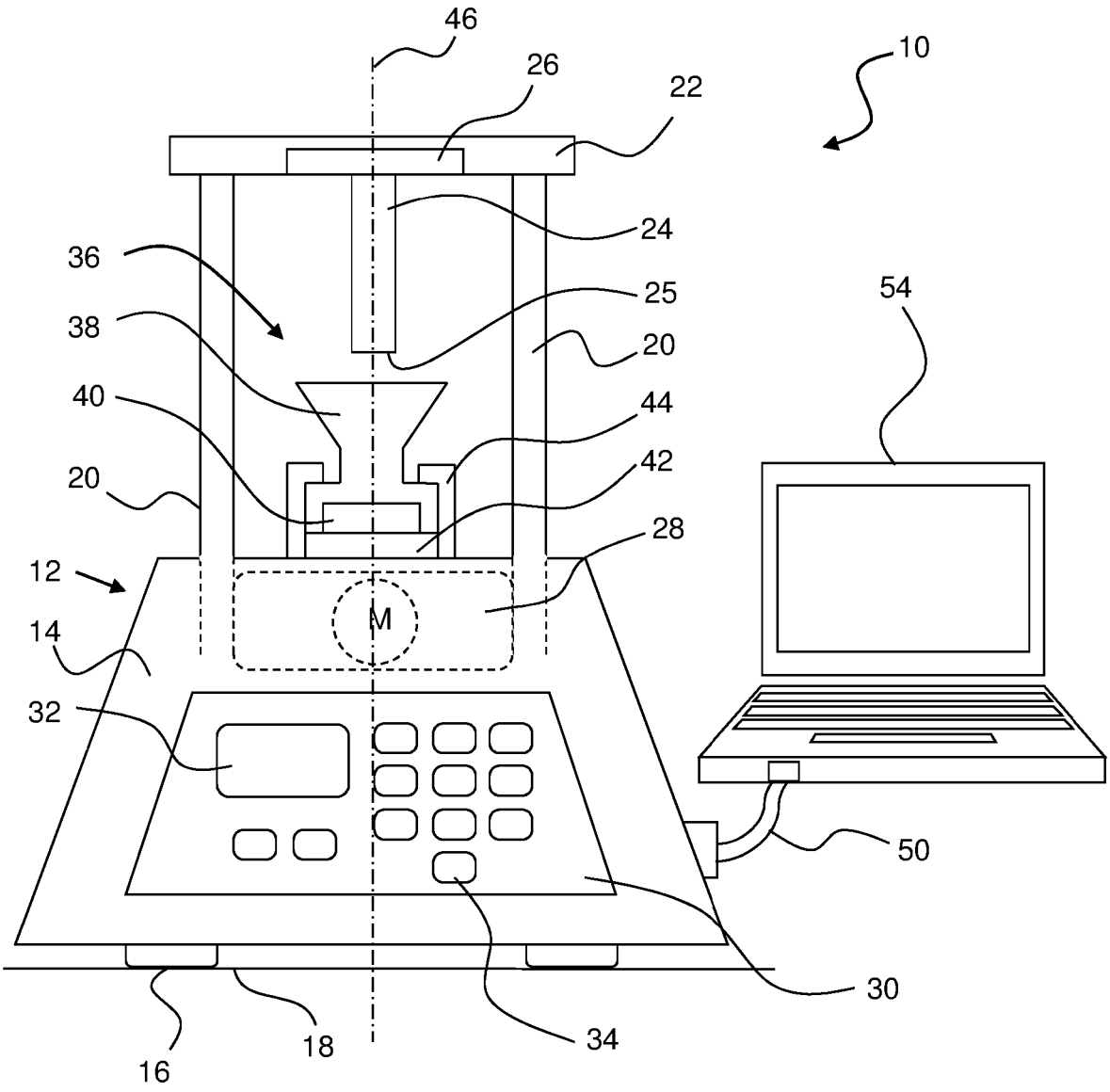
FIG. 1 shows a schematic front view of a tablet press.

In FIG. 1 there is shown a tablet press 10 having a base 12, which comprises a base housing 14. A lower region of the base 12 has feet 16 arranged to support the weight of the tablet press 10 on a suitable surface, such as a desk top 18, for use.

In the upper surface of the housing 14 there are provided a plurality of openings, through which spacer arms, in the form of support pillars 20, extend. The support pillars 20 have a lower end which is located within the base housing 14 and an opposing upper end which protrudes above the base housing 14. The support pillars 20 are arranged generally vertically when the feet 16 are on a horizontal surface 18.

At the upper end of the support pillars 20, there is provided a support member 22 which extends between the support pillars 20 and which is arranged generally perpendicular to the longitudinal axes of the support pillars 20. Mounted to the support member 22, there is provided a press member, which is referred to herein as punch 24. The punch 24 depends from the support member 22 at a location between, and typically equidistant from, the support pillars 20. The punch 24 is elongate in form and extends towards the base 12 in a direction which is generally parallel with the support pillars 20.

The punch 24 is generally cylindrical in shape although other shapes are possible including oval, square or other shapes to which tablets are conventionally formed. The punch 24 has a free end 25 which is blunt. The free end 25 defines in part the shape of a tablet formed by the tablet press 10 in use. Accordingly, the free end may be flat or curved in a desired tablet profile. In this regard, it may be possible to provide the punch 24 with interchangeable end sections to suit different tablet shapes. In such embodiments, the die shape will typically be interchangeable to correspond with the punch shape.

The support member 22 comprises a load sensor in the form of a load cell 26 arranged intermediate the punch 24 and the remainder of the support member. The punch 24, at its fixed end, may be mounted at or on the load cell 26, which may itself be mounted in a correspondingly shaped recess or formation in the support member.

The support pillars 20 terminate at their lower ends within the base housing 14. Mounted within the base housing 14 is an electric motor assembly 28, which, in this embodiment, comprises a conventional brushed DC motor. However, it will be understood that other types of motor may be used, such as, for example, brushless DC motors, including stepper motors. An electric motor is in many ways preferred as a suitable drive means for the tablet press due to the range of travel required by the support pillars 20. However, it should be noted that other forms of electromechanical drive or actuator could be considered provided they can allow for suitable linear displacement of the support pillars 20 in use.

The motor assembly 28 is shown schematically in FIG. 1 in cooperation with the support pillars 20, and drives the support pillars 20 to generate the compression force for the tablet press 10.

In this embodiment, the motor assembly 28 further comprises a linear servo amplifier which powers the motor. A digital encoder is also provided for the control of the motor. In this embodiment the encoder is an integral part of the motor assembly 28 within the base housing 14. Thus, in use, the angular position of the motor is determinable and digitally controllable as will be described in further detail below.

A user interface 30 is provided, for example on a panel of the base housing 14, and comprises a display screen 32 and a plurality of keys 32 in the form of a keypad. The keys allow for alphanumeric character entry by a user in a conventional manner.

In the upper portion of the base housing 14, there is provided a die assembly 36 comprising a die member 38 and a die floor or base 40. The die member and die floor are held in position against a plate 42 on the base 12 by retaining formations 44.

A force path can be defined between the motor assembly 28, the support pillars 20, the support member 22, including the load cell 26, and punch 24. The tablet press 10 and die assembly 36 are arranged so that the force acts along a working axis 46 that extends through the punch 24 and through the centre of the bore of the die member 38. Accordingly, a load applied by the motor can be communicated to the punch 24 such that the punch 24 applies a load to powder in the die. Any reaction to the applied load experience by the punch 24 can be recorded by the load cell 26. The motor 28 and load cell 26 are typically arranged to allow for a load of up to approximately 500 kg or 4900 N, although in some cases components suitable for loads of up to 50 kN will be required. The loads applied by the punch 24 during both the compaction and ejection operations can therefore be measured and recorded by the tablet press 10.

Although not shown in FIG. 1, the compaction mechanism may also comprise a second/lower load cell, located below the die assembly 36, as will be described in detail later.

Figure 2:
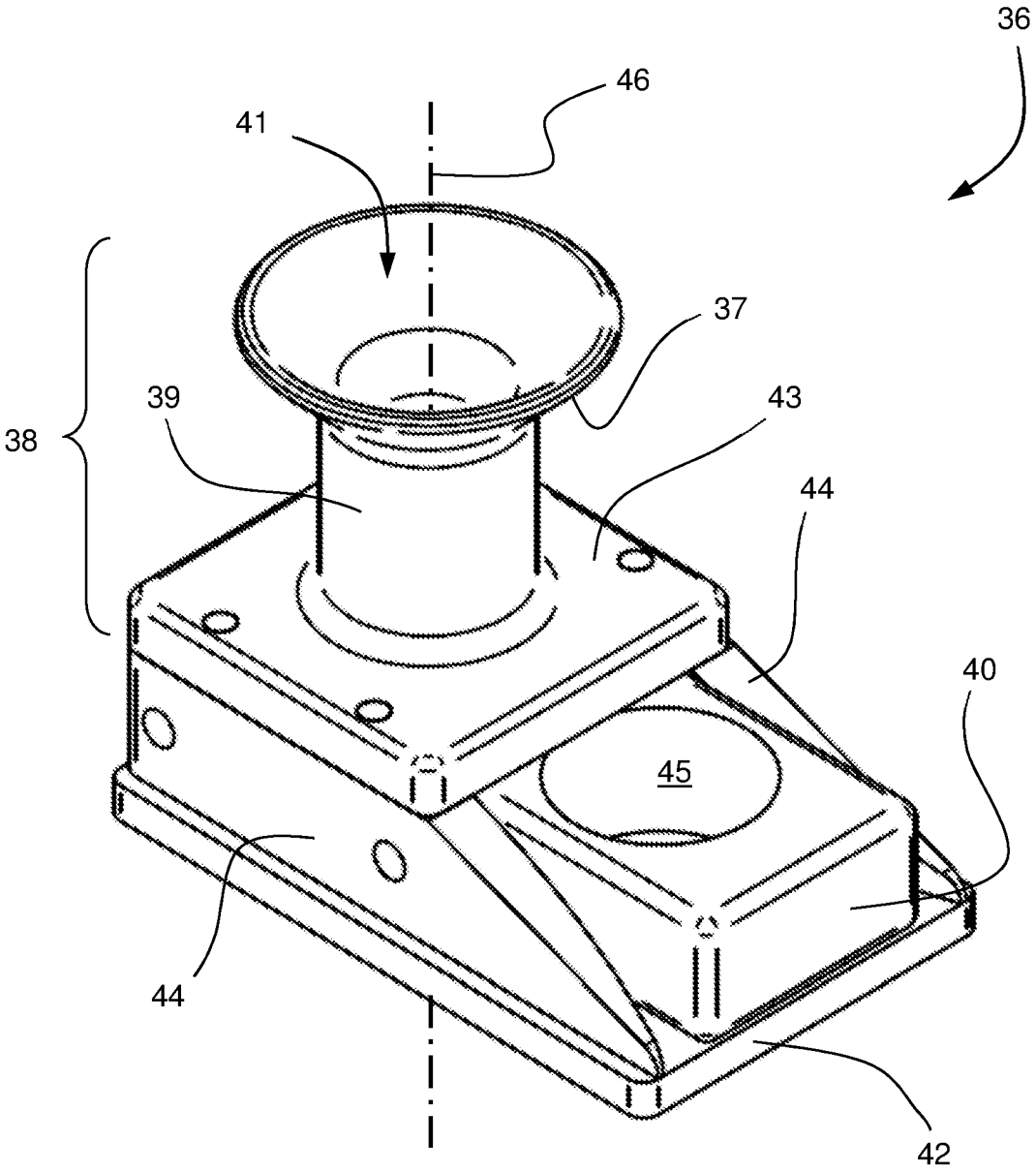
FIG. 2 shows a perspective view of a die assembly for use with the tablet press of FIG. 1.

An example of a die assembly 36 for use in conjunction with the base 12 of the tablet press 10 is illustrated in greater detail in FIG. 2.

The die assembly 36 comprises a die member 38 in its upper portion, shaped to define the die in which a tablet is formed in use. The die member 38 has an open ended funnel formation 37 leading to an upstanding wall 39 which is generally tubular or toroidal in shape and has a central opening or bore 41 into which powder can be inserted. The funnel 37 has an upwardly facing open mouth which tapers towards a narrow opening which leads into the bore 41 of the die member 38. The powder is held within the bore 41 in the die member 38 and supported by the floor or base 40 to create a column of powder within the upstanding wall portion 39 of the die member 38.

The die member 38 comprises a mounting portion 43 which is mounted to a pair of side walls 44, which extend at right angles to a base plate 42. The combined side walls 44, base plate 42 and the mounting portion 43 of the die assembly 36 therefore provide an opening with a rectangular cross section to partially enclose and restrain an intermediate member 40 which forms a base or floor to the die assembly 36. As illustrated, the base 40 comprises a slider block or drawer member having an opening 45 therein in the form of a cylindrical hole.

The slider block 40 can be actuated in forward and reverse directions between positions in which the opening 45 is respectively aligned with and offset with the bore 41 of the die member 38. The opening is a close fit about the slider block 40 in order to constrain the slider block 40 to a linear motion only. This close fit causes friction between each of the base plate 42, the side walls 44 and the mounting portion 43, and the slider block 40.

When forming a tablet, the slider block 40 is positioned as shown in FIG. 2, with the opening 45 offset from the bore 41 of the die member 38. The desired powder is then measured and poured into the funnel 37 of the die member 38, where is prevented from passing straight through the bore 41 by the tightly fitting slider block 40. This will be referred to as the first, or compaction, position.

With the die assembly 36 located in the tablet press 10 such that the bore 41 of the die member 38 aligned with the working axis 46, the punch 24 can be actuated to compress the powder to a predetermined degree, measured and controlled by the tablet press 10, before being withdrawn to leave the compressed powder in a chamber defined by the defined by the tubular upstanding wall 39 of the die assembly 36.

In order to eject a tablet from the die assembly 36, the slider bock 40 must first be actuated to a second, ejection, position, in which the opening 45 is beneath the bore 41 of the die member 38. This allows ejection of the tablet out of the bore 41 of the die member 38 and into the opening 45, for example by a further actuation of the punch 24.

The base plate 42 of the assembly is substantially planar in form and devoid of any opening. As such, the ejected tablet will be held in a cavity defined by the opening 45 and the base plate 42. A subsequent reverse sliding actuation of the slider block 40 back to the first position exposes the opening 45 and allows removal of the tablet by an operator, as well as preparing the die assembly 36 for the next compaction operation.

The base plate 42 has a greater length than the die mounting portion 43 of the die member 38 to allow the opening 45 to slide out from beneath the die member 38 for removal of the tablet without risk of the tablet falling through the opening 45.

The tablet press 10 of FIG. 1 is typically used for small batch manufacturing of bespoke tablets, or for testing and assessment of new tablet formulations rather than for mass production.

Typically, the action of moving the slider block 40 between the first and second positions has been achieved manually. However, a significant amount of force can be required to move the slider block 40. Aside from the friction that naturally arises from the tight fit between the slider bock 40 and the surrounding parts 42,43,44 of the die assembly, the powder making up the tablet also has a tendency to stick to the flat surface of the slider block during the compaction operation. As a result, forces of up to 50 kg (or 490N) are required to overcome the resistance and move the slider bock 40 from the first, compaction, position to the second, ejection, position. The size of the required force can be difficult for operators to apply by hand, causing discomfort and delaying the manufacture of tablets.

Perhaps more importantly, the current approach also provides no precise information about the forces involved in this operation. Information about the detachment force required for different formulations and different compaction pressures is of great interest and importance for future tabletting operations, particularly when the suitability of new formulations for mass production is being assessed.

One solution to these problems would be to include a further actuator and sensor arrangement, acting at right angles to the punch 24 of the tablet press 10, specifically for the purpose of moving the slider block 40 during the ejection operation. However, this solution would require additional motors and other components, and further control architecture within the press 10. A simpler solution is proposed by the present invention.

Figure 3:
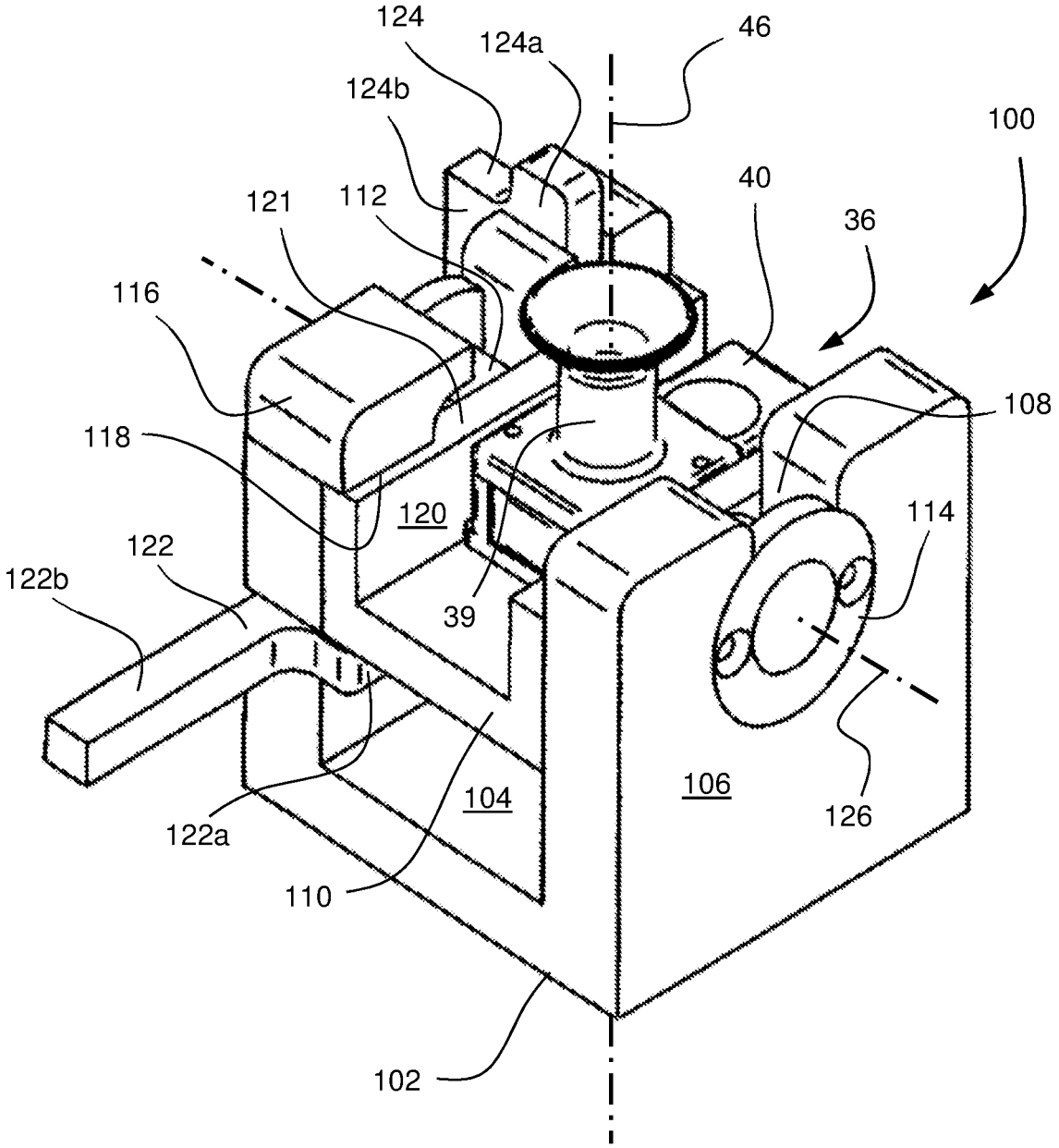
FIG. 3 shows a perspective view of a die mounting apparatus in accordance with the present invention in a first configuration.

A die mounting apparatus 100, for restraining a die assembly 36 in position, is illustrated in FIG. 3. The mounting assembly comprises a generally U shaped surrounding frame 102, having a base 104 and two upstanding wall portions 106. Channels 108 are provided centrally in each of the upstanding wall portions 106 to support a smaller pivoting U shaped frame, or tray 110, which in turn receives a die assembly 36 as shown in FIG. 2. The smaller U shaped tray 110 is aligned with and fits within the surrounding frame 102. A pair of rods 112 extend from the sides of the tray 110 and are received in the channels 108 in the upstanding wall portions 106 of the surrounding frame 102, and are supported in place by bearings 114. This provides the pivot between the smaller U shaped frame and the surrounding frame 102

A fixed stop 116 is provided on one of the upstanding wall portions to limit the rotation of the tray 110 within the surrounding frame 102 to ninety degrees. As shown in FIG. 3, the fixed stop 116 projects inwardly of the upstanding wall portion 106 so that a lower surface 118 of the fixed stop 116 engages with an upper surface 121 of a sidewall 120 of the smaller tray 110 to prevent rotation of the tray beyond the horizontal position shown in FIG. 3.

A first selectively engageable stop member 122, comprising a blocking portion 122*a* and a lever 122*b*, is pivotally mounted to a lower part of the upstanding wall portion 106 which comprises the fixed stop 116. As shown in FIG. 3, the first selectively engageable stop member 122 is in its engaged position with the lever 122*b* pivoted in line with the upstanding side wall 106 so that the blocking portion 122*a* extends inwardly of the surrounding frame 102 below the tray 110. The tray 110 is therefore held in the desired horizontal position between the blocking portion 122*a* of the first selectively engageable stop member 122 and the lower surface 118 of the fixed stop 116.

A second selectively engageable stop member 124 is also shown, in a position, behind the die assembly 36. The second selectively engageable stop member 124 similarly comprises a blocking portion 124*a* and a lever 124*b*, and is pivotally mounted to the upstanding wall portion 106 which comprises the fixed stop 116. In the disengaged position as illustrated, the blocking portion 124*a* can be seen extending vertically upwards from the upstanding wall portion 106 so as not to extend inwardly of the surrounding frame 102. It should also be clear that the pivot between the second selectively engageable stop member 124 and the upstanding side wall 106 is perpendicular to the pivot between the first selectively engageable stop member 122 and the upstanding side wall 106.

The die mounting apparatus 100 containing the die assembly 36 is received, in use, in a tablet press 10 such as that shown in FIG. 1. FIG. 3 shows the die mounting apparatus in a compaction configuration, with the smaller U shaped tray 110 held horizontally. The die mounting apparatus 100 will be located so that the axis 46 along which the punch 24 will move is precisely aligned with the centre of the chamber defined by the tubular upstanding wall 39 of the die assembly 36 so that the punch 24 can reliably compress powder received in the die assembly 36. The die assembly may be permanently fixed to, or formed integrally with, the tray 110, or may be removably attached thereto.

The axis 126 about which the tray 110 rotates passes through the slider block 40 and intersects the working axis 46 at right angles. The significance of this will be clear with reference to FIG. 4, which shows the same die mounting apparatus 100 in a second configuration.

Figure 4:
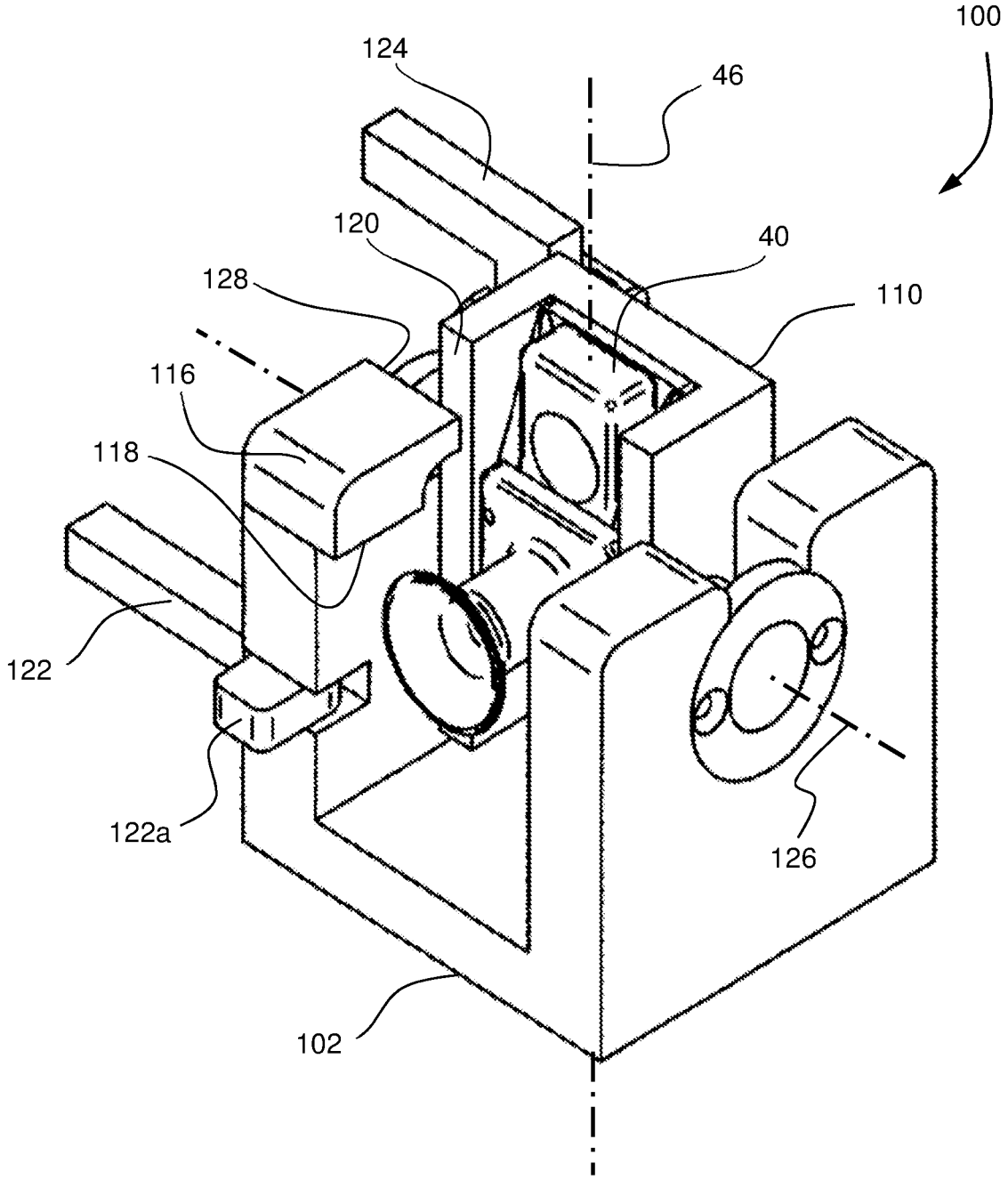
FIG. 4 shows a perspective view of the die mounting apparatus of FIG. 3 in a second configuration.

In FIG. 4 the tray 110 has been rotated about the axis 126 through ninety degrees to a vertical position. The intersection of the pivoting axis 126 with the working axis 46 of the tablet press 10, described above, means that the working axis 46 is now aligned with the centre of the slider block 40. As a result, the punch 24 of a tablet press 10 of the type shown in FIG. 1 can be used to apply a force to the slider block 40. The configuration shown in FIG. 4 can therefore be referred to as a sliding configuration.

To move the die mounting apparatus 100 from the compaction configuration of FIG. 3 to the sliding configuration of FIG. 4 requires only a few simple steps. Firstly, the first selectively engageable stop member 122 is pivoted to its disengaged position, withdrawing the blocking portion 22*a* as shown in FIG. 4 so that the tray 110 is able to pivot away from the lower surface 118 of the fixed stop 116. With the second selectively engageable stop member 124 still in its disengaged position, as shown in FIG. 3, the tray 110 is then pivoted until the upper surface 121 of its sidewall 120 engages with a vertical surface 128 of the fixed stop 116. Finally, the second selectively engageable stop member 124 is pivoted into its engaged position, extending its blocking portion 124*a* inwardly of the surrounding frame 102 behind the U shaped tray 110 as shown in FIG. 4. The tray 110 is therefore held in a vertical position between the blocking portion 124*a* of the second selectively engageable stop member 124 and the vertical surface 128 of the fixed stop 116.

Significantly, the pivoting action of the die mounting apparatus 100 permits repeatable movement of the die assembly 36 between a horizontal position, where the working axis 46 of a tablet press aligns with the chamber for forming a tablet, and a vertical position in which the working axis 46 aligns with the end of the slider block 40.

The thickness of the slider block 40 is greater than the diameter of the end 25 of the punch 24 of the tablet press. The punch 24 can therefore be used to form and eject the tablet as before (with the die mounting apparatus 100 in the compaction configuration of FIG. 3), and additionally to move the slider block 40 between its first, compaction position and its second, ejection, position. The tablet press 10 is already capable of measuring and recording the load applied by the punch 24 during tablet formation and ejection, so by using the same punch to move the slider block 40 the forces involved in this operation (the detachment forces) can also be readily, and centrally, measured and stored.

The invention provides a further benefit over a static die mounting. In order to minimise the time taken to form and eject a tablet, it is desirable to minimise the stroke of the punch 24 of the tablet press by minimising the distance between the free end 25 of the punch 24 and the top of the die assembly 36. The result of this is that there is insufficient clearance between the free end 25 of the punch 24 and the top of the funnel 37 to allow powder to be poured into the die member 38 with the die assembly 36 in position within the press. Instead, the die assembly 36 would have to be removed from the press 10 for filling, and then reinserted and correctly aligned with the working axis 46 between every operation.

The pivoting action of the die mounting apparatus 100 allows for the funnel 37 to be pivoted away from the working axis 46 to give sufficient clearance for filling. The U shaped tray 110 can be pivoted to an angle between the extreme positions shown in FIGS. 3 and 4 so that the bore 41 of the die member is clear of the punch 24, but the angle of the funnel 37 does not pass beyond the horizontal.

Figure 5:
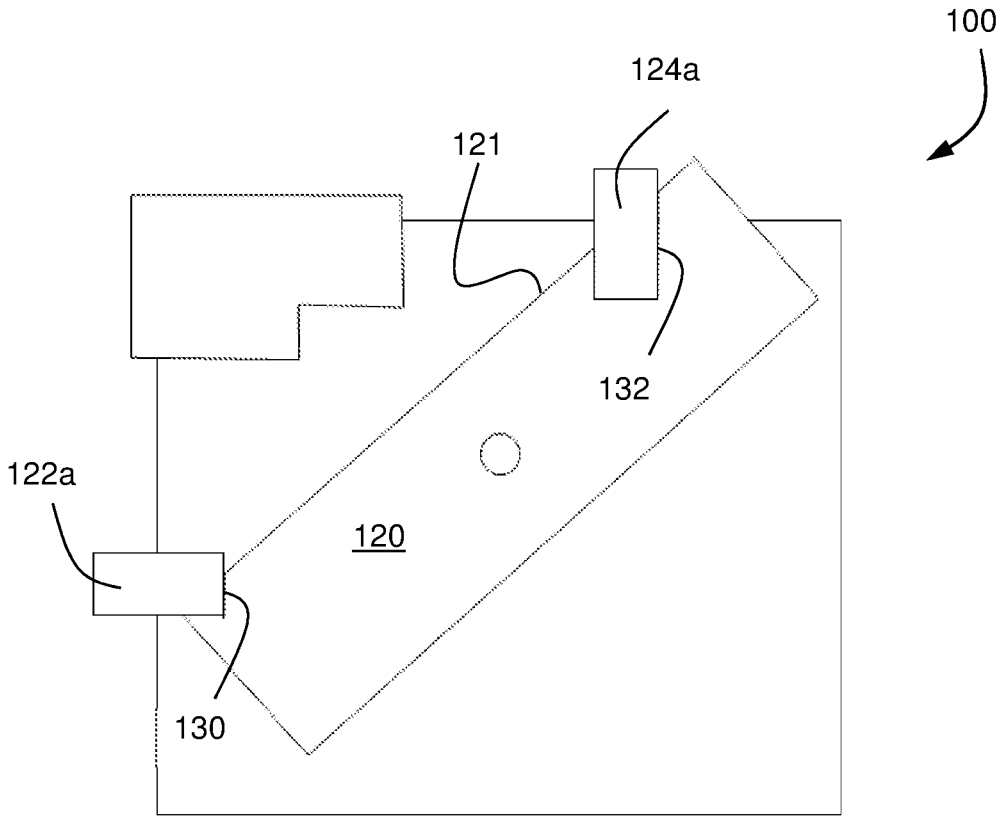
FIG. 5 shows a schematic view of a modified die mounting apparatus in accordance with the present invention in a third configuration.
Figure 6:
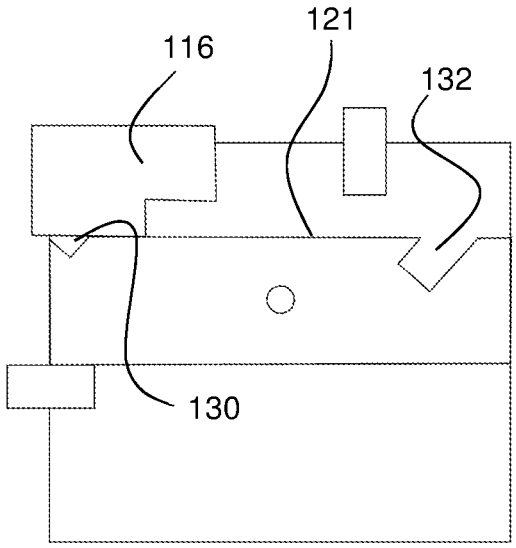
FIG. 6 shows a schematic view of the modified die mounting apparatus from FIG. 5 in the first configuration shown in FIG. 3.
Figure 7:
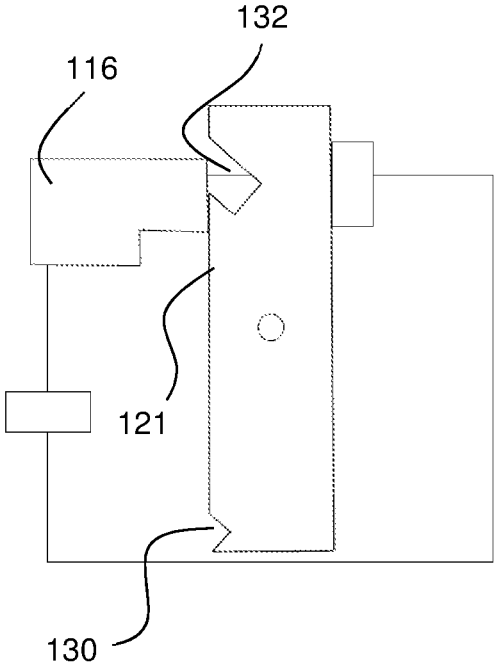
FIG. 7 shows a schematic view of the modified die mounting apparatus from FIG. 5 in the second configuration shown in FIG. 4.

FIG. 5 shows a schematic view of a modification allowing the tray 110 of the die mounting apparatus 100 to be held at an angle of approximately 45 degrees for a filling operation. Two notches 130,132 cut in upper surface 121 of the sidewall 120 allow the blocking portions 122*a*,124*a* of the existing selectively engageable stop members 122,124 to engage with the sidewall 120 and hold the tray 110 at a fixed angle between the compaction and sliding positions. FIGS. 6 and 7 show the same modification with the tray 110, respectively, in the horizontal compaction position of FIG. 3 and the vertical sliding position of FIG. 4. In neither case does the presence of notches 130,132 affect the interaction between the upper surface 121 of the sidewall 120 and the fixed stop 116.

The blocking portions 122*a*,124*a* need extend no further inwardly of the surrounding frame than the thickness of the sidewall, allowing freedom of the positioning of the notches 130,132 without impacting on the space for the die assembly 36 within the tray 110. Alternative positioning of the notches 130,132 along the upper surface 121 or along an end of the sidewall 120 would allow fixing of the tray at different angles. Indeed, the use of notches 130,132 rather than simple stops allows a single selectively engageable stop member 122,124 to hold the tray 110 at a particular angle. As such, it would be possible to alter the spacing of notches so that they could not simultaneously be engaged by the two selectively engageable stop members 122,124. This would result in two fixed positions between the compaction and sliding positions.

Accurate and precise positioning of the die assembly 136 in the positions shown in FIGS. 3 and 4 is important for effective operation and to avoid damage to the end 25 of the punch 24 during operation of the tablet press 10. Precise positioning is less important for the filling operation, where a user could simply hold the die assembly 36 in place while filling. As a result, notches such as those shown in FIGS. 5 to 7 need not necessarily be provided in order for the invention to provide the described benefit.

A further alternative die mounting apparatus 300 is illustrated in FIGS. 16 to 19. The alternative mounting apparatus 300 is similar to the earlier described apparatus 100, comprising a similar generally U shaped surrounding frame 302 supporting a smaller pivoting U shaped frame, or tray 310 on bearings 314. The smaller U shaped tray 310 receives a die assembly 36, and provides a similar pivoting arrangement as described in relation to FIGS. 3 and 4 above. In each of FIGS. 16 to 19 a removable punch 24*a* is shown received within the bore 41 of the die assembly 36 to close the bore 41 and avoid possible contamination when it is not in use.

The main difference between the alternative die mounting apparatus 300 of FIGS. 16 to 19 and the apparatus 100 of FIGS. 3 and 4, is that the alternative die mounting apparatus 300 comprises only a single selectively engageable stop member 322.

Figure 16:
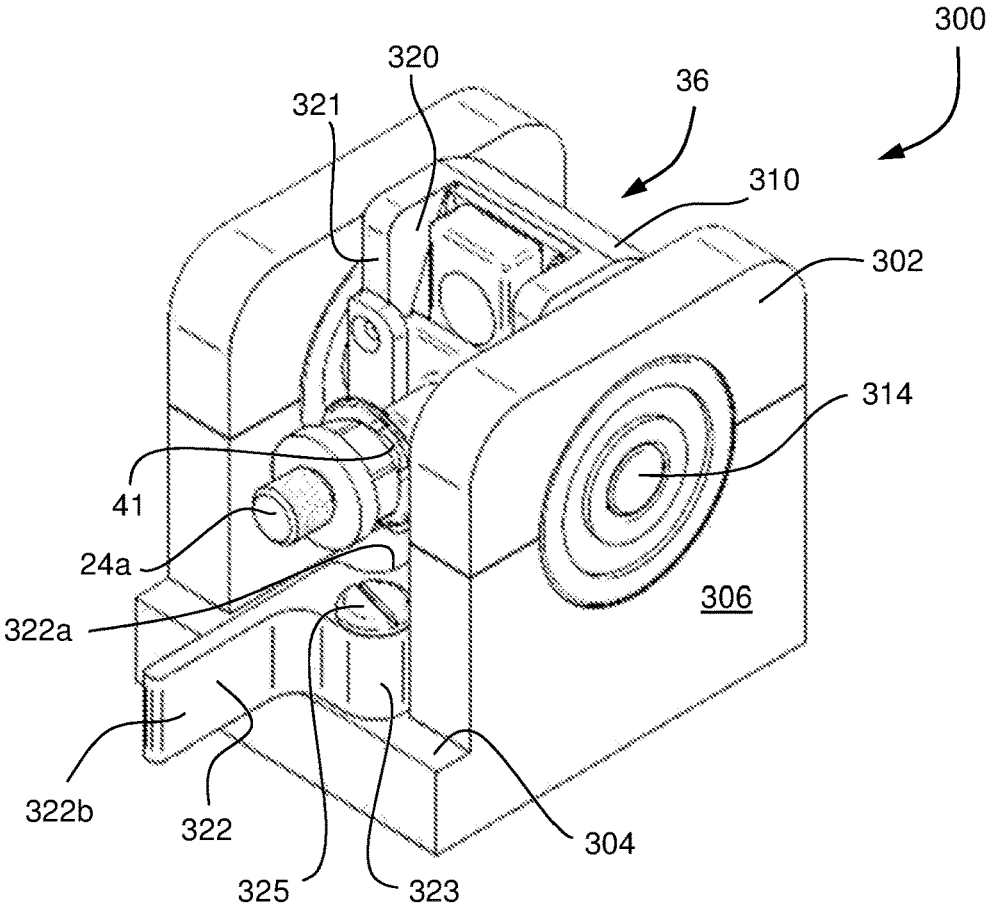
FIG. 16 shows a perspective view of alternative die mounting apparatus in a first configuration.
Figure 17:
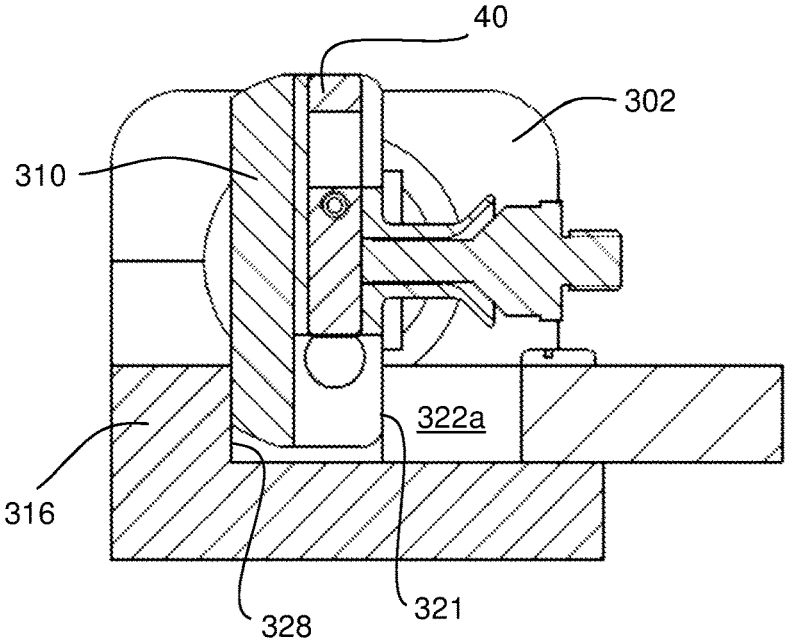
FIG. 17 shows a cross-sectional view of the die mounting apparatus from FIG. 16.

FIG. 16 shows the same 'sliding configuration' as FIG. 4. The single selectively engageable stop member 322 has a blocking portion 322*a*, which is largely concealed in FIG.

16, and a lever 322*b*. A central portion 323 of the selectively engageable stop member 322 is mounted at a pivot 325 to the base 304 of the surrounding frame 302 adjacent one of two upstanding wall portions 306. The base 304 of the surrounding frame 302 extends beyond one end of the upstanding wall portions 306, allowing the pivot 325 to be aligned with one end of the upstanding wall portions 306. The pivot 325 is provided by a bolt in the illustrated example.

As shown in FIG. 16, the blocking portion 322*a* extends along the inside of one upstanding wall portion 306 and engages with an upper surface 321 of a sidewall 320 of the smaller tray 310. This can be seen more clearly in the cross sectional view of FIG. 17. The fixed stop 316 in this embodiment can also be seen at the opposite end of the surrounding frame 302, and the smaller U shaped tray 310 is held in a vertical position between a vertical face 328 of the fixed stop 316 and the blocking portion 322*a*.

The central portion 323 of the selectively engageable stop member 322 has a curved outer surface so that it can pivot away from the position shown in FIG. 16 through up to 90*o* so that the blocking portion 322*a* extends across at right angles between the two upstanding wall portions 306 and the lever 322*b* abuts the end of its adjacent upstanding wall portion 306. The tray 310 is then free to pivot away from the vertical face 328 of the fixed stop 316, past the blocking portion 322*a*, into a horizontal position similar to that shown in FIG. 3. The selectively engageable stop member 322 can then be rotated back to the position described in FIG. 16, to arrive at the configuration shown in FIG. 18.

Figure 18:
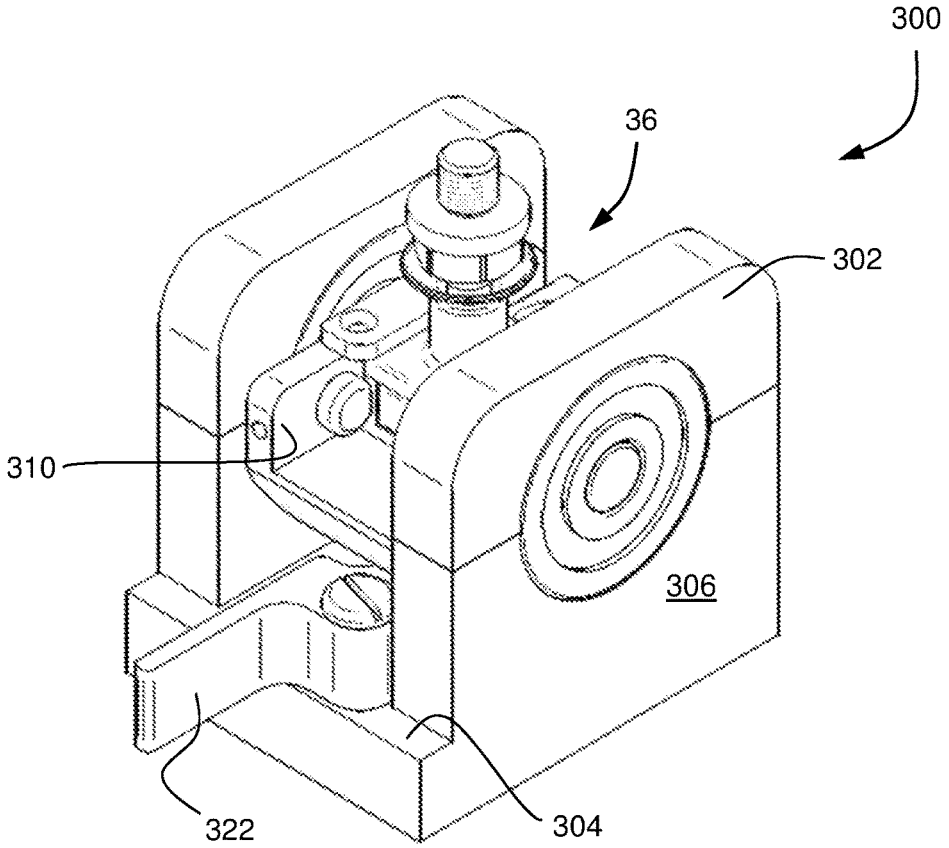
FIG. 18 shows a perspective view of alternative die mounting apparatus in a second configuration.

FIG. 18 shows the alternative die mounting apparatus 300 with the tray 310 locked in the horizontal 'compaction configuration'. The blocking portion 322*a* of the selectively engageable stop member 322 is again obscured from view by the tray 310 and surrounding frame 302, and its position will be better understood with reference to the cross-sectional view of FIG. 19.

Figure 19:
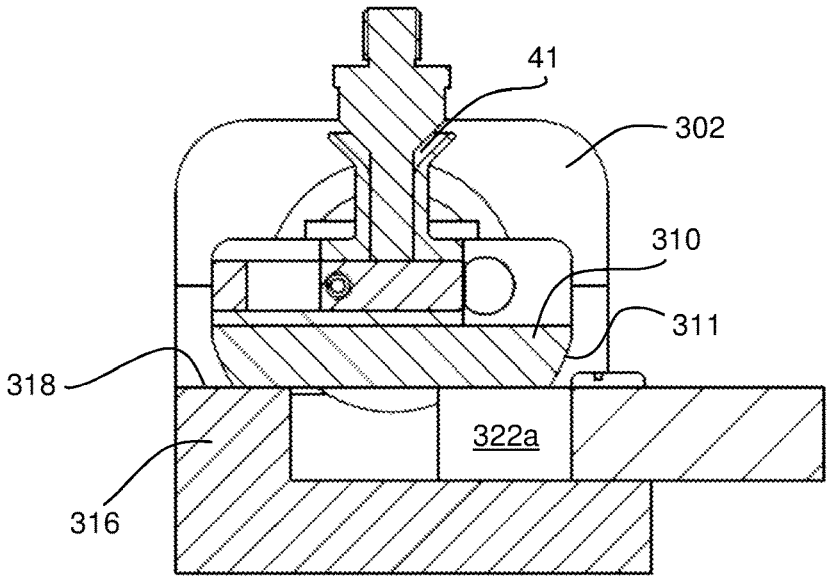
FIG. 19 shows a cross-sectional view of the die mounting apparatus from FIG. 18.

As shown in FIG. 19, the underside of the tray 310 is engaged with a horizontal surface 318 of the fixed stop 316 at one end of the supporting fame 302, and with an upper surface of the blocking portion 322*a* at the other. The tray 310 cannot, therefore, rotate from this position until the selectively engageable stop member 322 is rotated out of this position as described above. A chamfer 311 at the end of the tray 310 helps to provide sufficient clearance for the tray 310 to rotate past the blocking portion 322*a* when disengaged without compromising the compact overall size of the apparatus 300.

As with the earlier apparatus 100, the axis about which the tray 310 rotates passes through the slider block 40 of the die assembly 36 and will be positioned to intersect the working axis 46 of a tablet press at right angles in use. Therefore, the punch 24 of a press will align with the slider block 40 of the die assembly in the sliding configuration of FIG. 16 and with its bore 41 in the compaction configuration of FIG. 18 without any movement of the assembly 300.

It will be understood that the apparatus 300 of FIGS. 16 to 19 provides the same benefits as the earlier described apparatus 100 of FIGS. 3 and 4, including significantly, the repeatable movement of the die assembly 36 between a horizontal position and a vertical position, but with only a single selectively engageable stop member 322.

Although described in relation to a manually operated system, the invention also provides benefits in more automated tablet manufacture, with a separate automated weighing/measuring of powder and automated delivery into the die member 38. In an automated system, the pivoting action between the tray 110,310 and the surrounding frame 102,302 could be powered by a motor, and the selectively engageable stop members 122,124,322 could likewise be automated. Alternatively, all stop members 116,122,124,316,322 could be omitted and the entire operation of pivoting and fixing the tray 110,310 in desired positions could be achieved using a stepper motor with suitable control architecture.

Figure 8:
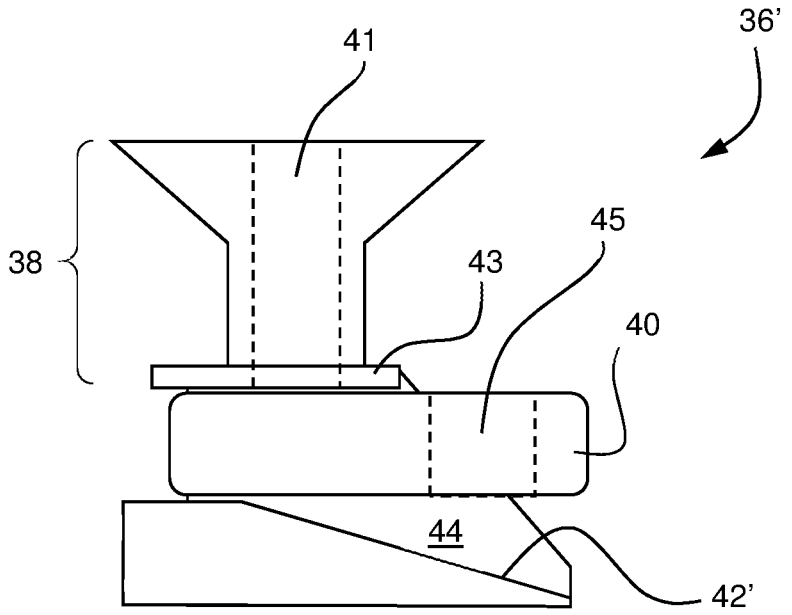
FIG. 8 shows a schematic view of a modified die assembly in a first configuration.
Figure 9:
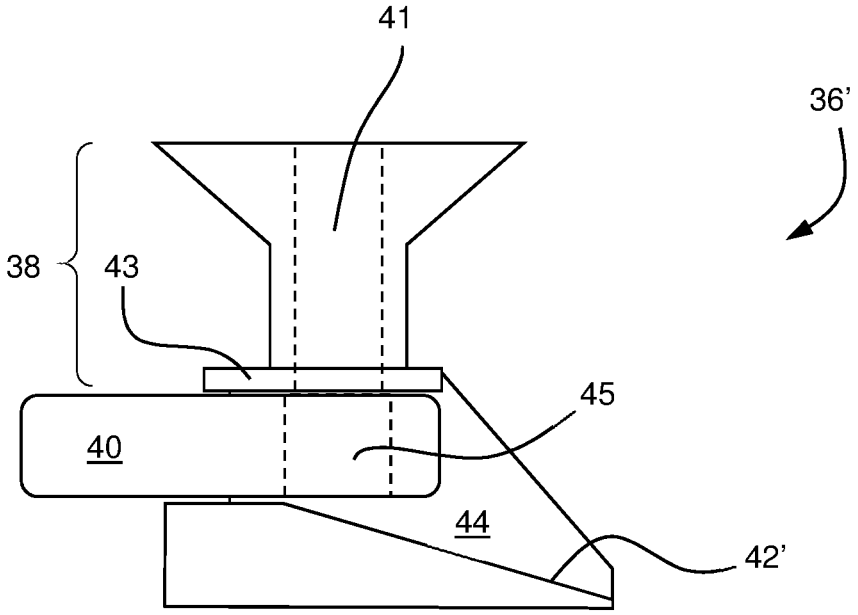
FIG. 9 shows a schematic view of the modified die assembly of FIG. 8 in a second configuration.

FIGS. 8 and 9 schematically show a modified die assembly 36' which would be of particular use in an automated system as described above, but would also find use in a manually operated system. The modified die assembly 36' is similar in many ways to the known die assembly 36 described in relation to FIGS. 1 and 2.

FIG. 8 shows the die assembly 36' in the compaction position. The mounting portion 43 of the die member 38 is joined to a base plate 42' by a side wall 44 at the rear of the die assembly 36' as shown. The other, opposite, side wall 44 has been omitted in FIG. 8 so as not to obscure the slider block 40. The bore 41 of the die member 38 and the opening 45 of the slider block 40 are illustrated in broken lines. Significantly, the base plate 42' is not flat, but instead incorporates a slope from a position below the bore 41 to one end of the die member 36'. The base plate 42' also has a flat area which together with the mounting portion maintain the slider block horizontal to provide a flat base for forming a tablet.

FIG. 9 shows the same modified die assembly 36' in an ejection position. With the slider block oved to align the opening 45 with the bore 41 in the die member 38, a tablet ejected from the bore 41 will pass through the opening 45 and down the sloping surface of the base plate 42' where it can be collected in a suitable container.

As an alternative to the sloping surface illustrated in FIGS. 8 and 9, it should be understood that a sloping channel could be cut through a base plate to retain a larger flat upper surface to keep the slider block 40 horizontal. The sloping surface or channel could even be provided in one end of the slider block, provided that sufficient clearance was allowed for the tablet to clear the lower end of the bore 41 in the die member 38 when the slider block was moved to the ejection position.

Figure 10:
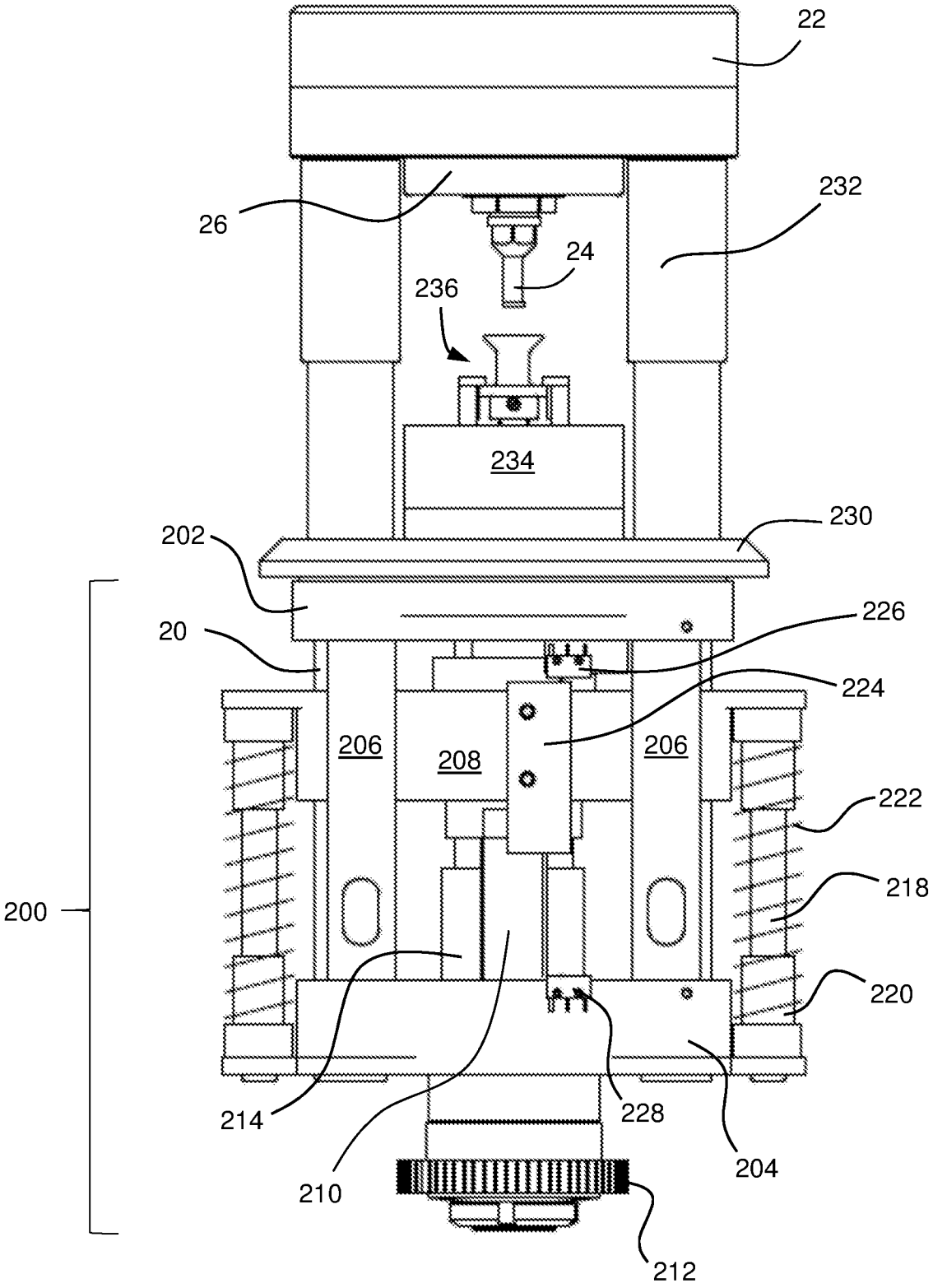
FIG. 10 shows a front view of the compaction mechanism of a tablet press according to the invention.
Figure 11:
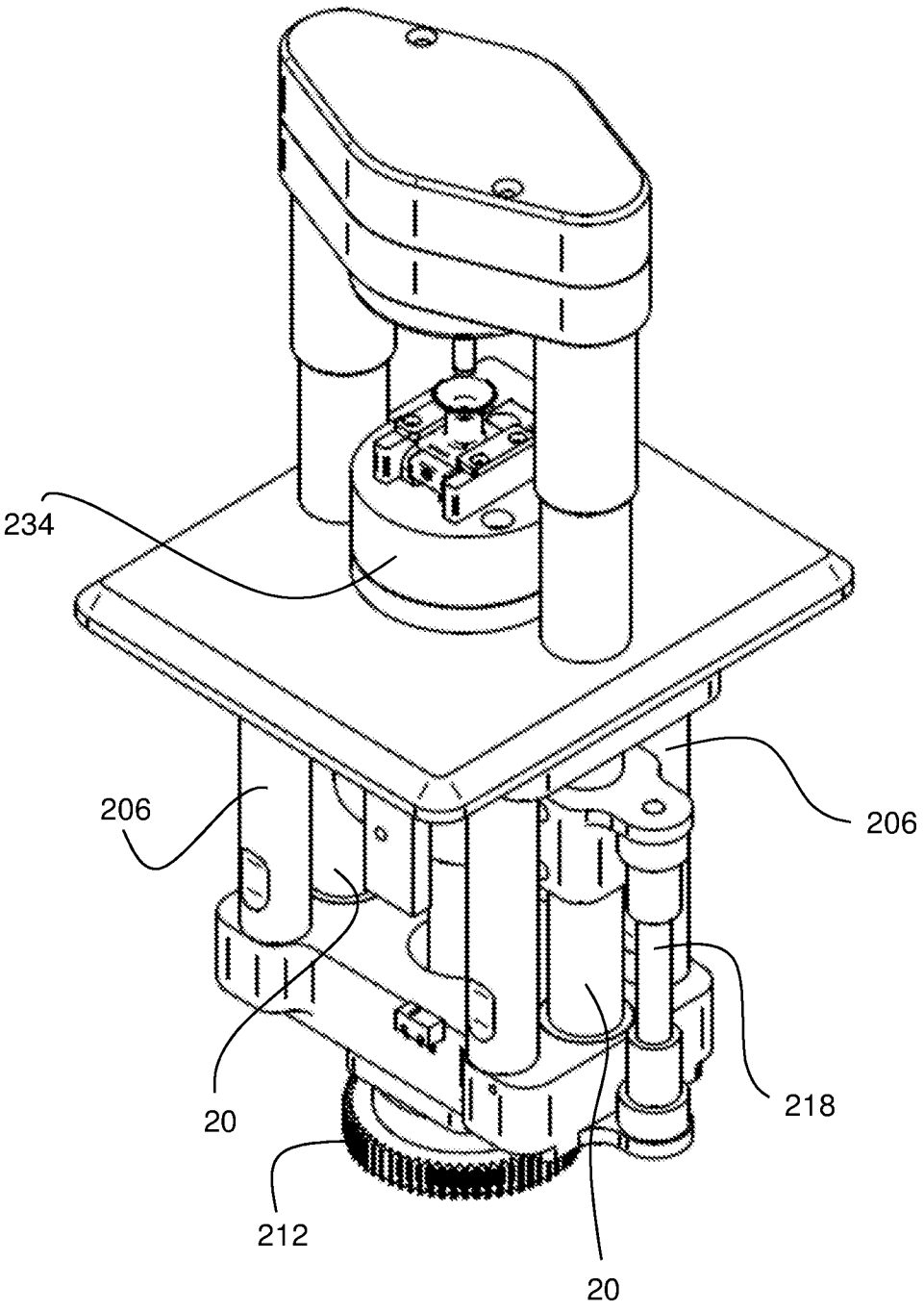
FIG. 11 shows a perspective view of the mechanism from FIG. 10.

Further detail of the compaction mechanism is shown in FIGS. 10 and 11. In FIG. 1 a large part of the mechanism was obscured by the housing 14 of the tablet press 10, so in FIGS. 10 and 11 the mechanism is shown in isolation.

The lower part of the mechanism, generally indicated 200, comprises an upper plate 202 and a lower plate 204 which are separated by four static pillars 206 to form a fixed frame. Each of the two support pillars 20 of the mechanism, as can be better seen in FIG. 11, extends through apertures in the upper and lower plates 202,204 between a pair of the static pillars 206.

A yoke 208 is attached to both support pillars 20 between the upper and lower plates 202,204. The interior of the yoke 208 provides a ball screw with a threaded rod 210 which is mounted on thrust bearings in the upper and lower plates 202,204 and passes through the centre of the yoke 208. A driven gear 212 is provided on one end of the threaded rod 210 below the lower plate 204 so that the threaded rod can be driven in rotation by a drive gear (not shown) connected to a motor 214 which is secured to the lower plate 204. The ball screw arrangement provided by the yoke 208 and the threaded rod 210 provides a low friction linear actuator so that the yoke 208, and therefore the support pillars 20 can be moved vertically with great precision.

On the sides of the mechanism, outside the support pillars 20, additional support rods 218 are provided. The support rods 218 are fixed to extensions of the yoke 208 at their upper ends, while their lower ends pass through holes in extensions of the lower plate 204. Collars 220, of a larger diameter than the support rods 218, are provided at both ends of each support rod 218 to form location sites for a pair of compression springs 222. The compression springs 222 ensure that a biasing force is constantly present on the yoke 208 so that the ball screw is properly and consistently seated. This helps to avoid the possibility of any remaining play/slop within the ball screw causing inconsistencies in the precise position of the yoke 208.

The various features described above allow for great precision and confidence of relative position of the yoke 208, and therefore of the support pillars 20, for any given rotational position of the motor 214. As a result, reliable operation of the tablet press can be achieved simply through appropriate control of the motor 214 without the need for dedicated sensors to monitor the position of the punch 24

As illustrated in FIG. 10, the mechanism is at the upper end of its movement, and the lower ends of the support pillars 20 and of the spring support rods 218 can just be seen extending below the lower plate 204. A block 224, which is fixed to the yoke 208, is shown with its upper end adjacent a microswitch 226 provided on the upper plate 202. Microswitch 226 acts as a limit switch at the upper end of the movement of the mechanism during calibration of the tablet press 10 and/or as a failsafe during use. A similar microswitch 228, provided on the lower plate, serves the same purpose at the lower end of the movement. Although not illustrated, it will be understood that the lower ends of the support pillars 20 and of the spring support rods 218 will extend noticeable further through the lower plate 204 when the mechanism is at the lower end of its movement range.

FIGS. 10 and 11 also show additional detail of the upper part of the mechanism. The upper ends of the support pillars 20, above the upper plate 202 and flange 230, are housed within telescoping pillar guards 232 to shield the support pillars, and the remainder of the mechanism from powder and any other debris. The upper load cell 26 is housed within the support member 22. The second, lower, load cell assembly 234, located below a modified die assembly 236, is also shown in FIGS. 10 and 11.

Figure 12:
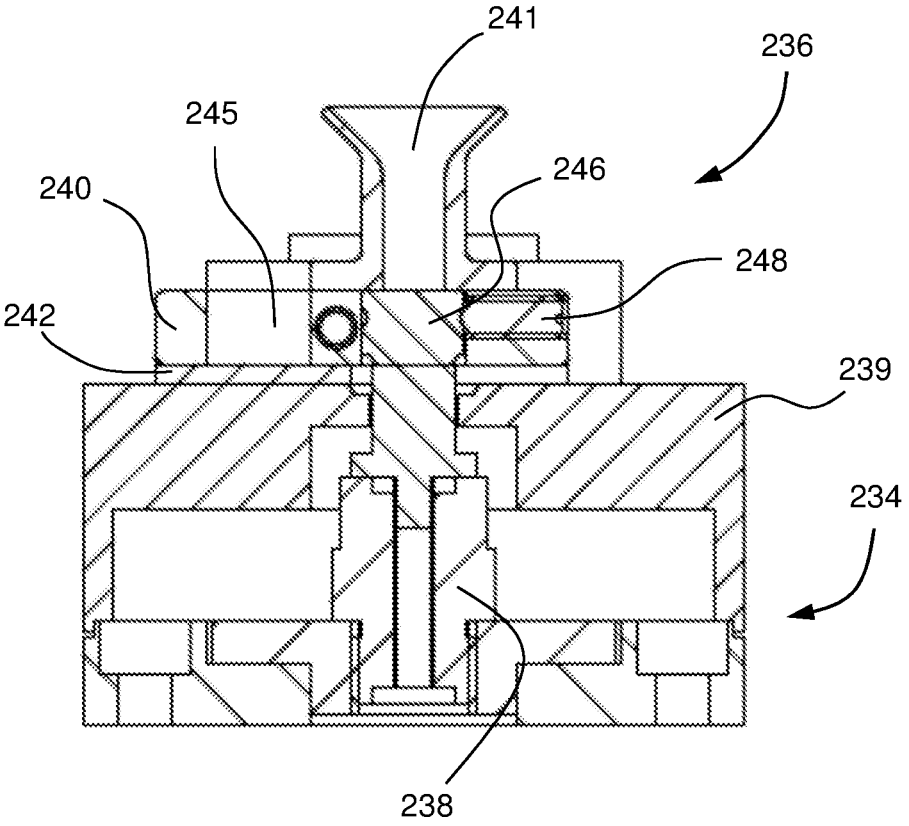
FIG. 12 shows a cross sectional view of a modified die assembly located on a lower load cell assembly.

FIG. 12 shows some details of the modified die assembly 236 and the lower load cell assembly 234. The load cell assembly 234 comprises a compression load cell 238 within a housing 239. A head of the load cell 238 extends through the upper end of the housing 239 and is located below the bore 241 of the die assembly 236 and, in use, in line with the with the working axis 46 of the tablet press 10.

The die assembly 236 shown in FIG. 12 is similar in many respects to the die assembly 36 previously shown in FIG. 2. A slider block 240 provides a movable floor/base with an opening 245 to receive an ejected tablet once formed. One difference is that the slider block 240 comprises a region, in the form of a small disc 246, that is vertically movable relative to the remainder. The disc 246 is located directly beneath the bore 241 of the die assembly 236 when in the compaction position as shown, and is held in place within the remainder of the slider block 240 by a ball spring screw 248. Also in contrast with the die assembly of FIG. 2, the base plate 242 extends only beneath one end of the slider block 240 of the die assembly in FIG. 12 such that the disc 246 of the slider block 240 can rest directly on the head of the compression load cell 238. As a result, the lower load cell 238 provides a direct measurement of the reaction force at the lower end of a column of powder within the bore 241 during compression.

The tablet press 10 of the present invention is designed to form small batches of tablets, often from bespoke or unusual formulations of powder. As described above, these formulations are received in the die assembly 36,236 to provide effectively a column of powder, often with unknown compaction characteristics, aligned with the working axis 46 of the tablet press 10. The mechanical interactions of powders during compaction are complex, and it is quite possible that interactions within the column of powder will result in discrepancy between the force experienced at the upper end of the column and at its lower end. In particular, during formation of a tablet there will be frictional losses within the powder and lateral pressure on the sidewalls of the die due to compression of the powder. These can differ significantly between different powder compositions. The die wall pressure provides useful information about a tablet composition, but is extremely difficult to measure directly.

By providing first and second load cells 26,238 as described above, separate readings can be obtained for the opposite ends of the column of powder within the die assembly 236. The difference between the readings quantifies the losses occurring within the die assembly 236. This information can be used to calculate the die wall pressure for any particular powder composition in a way that is being compressed.

The operation and control of the tablet press by a controller will now be described. The tablet press 10 comprises one or more processors, typically in the form of a microchip, and a data store or memory for controlling actuation of the punch by the motor 28 in accordance with user inputs.

The tablet press further comprises means for establishing a data connection with a separate computing means. In this embodiment, the tablet press 10 is connected by a lead 50 to a laptop 54. Additionally, or alternatively, a wireless data link may be established in different embodiments by providing the tablet press with conventional wireless data transfer hardware, such as may be required for data transmission/reception by radio using, for example Wi-Fi, GSM, 3G, Bluetooth or other communication standards.

Whilst a laptop 54 is shown in FIG. 1, the reader will appreciate that numerous forms or alternative computational equipment exist which could be substituted, such as, for example, a desktop personal computer, PDA, mobile/cell phone, computer tablet or similar.

The operating system for the tablet press comprises two parts. The processor in the tablet press 10 itself is provided with machine-readable code in the form of firmware. The PC 54 is provided with software that controls the display of an on-screen user interface 32.

Reference will now be made to the flow chart of FIG. 13, which shows an example of a tablet compaction routine in the firmware.

After switching the tablet press on at 52, the firmware enters a machine start-up sequence at which point the tablet press waits until the PC software is started.

The tablet press then initialises by actuating the motor 28 such that the punch is moved to a fully retracted position, as determined by the first microswitch 226. This position serves as the datum position for the machine. Any settings stored in the memory from a previous instance of use are retrieved from the memory.

Once the tablet press firmware establishes data communication with the PC, tablet pressing parameters can be set at 55 or altered using the user interface 30 on the tablet press 10 or an interface on the PC 54. The parameters that are required for entry or upload by a user comprise the following:

a. Compaction mode: Either fixed thickness or fixed load modes are available. In fixed thickness mode, the contents of the die will be compacted until the die reaches a specified position. In fixed load mode, the compaction continues until a specified load is applied to the punch (as determined by the load cell 26 and/or 238);
b. Target thickness or load: The desired tablet thickness or maximum load, depending on the mode set in (a) above;
c. Compaction speed;
d. Die diameter: This is for information and is shown on the header of exported reports, but, in this embodiment, has no bearing on the compaction itself;
e. Die thickness: The total thickness of the die, which is used to calculate positions during the compaction routine.

Before a compaction can be started, the position of the bottom of the die is established by the firmware at stage 60. The insertion of different dies into the press may change this parameter. The determination of the location of the floor of the die relative to the datum position at 60 is achieved by placing the empty die in the machine and starting the 'new size' procedure. The firmware controls actuation of the punch 24 downwards until it touches the die floor member 40. The distance of travel and/or position of the die floor 40 relative to the datum position is stored. The punch 24 then retracts out of the die 38.

The die is now loaded with powder by a user. This may be achieved by removing the die 38 or die assembly 36 and inserting powder therein using a suitable dispensing device. Alternatively, this may be achieved in-situ. Once the die and powder therein is correctly positioned in the tablet press 10, the compaction stage can begin.

The compaction is started from the PC. The firmware is able to calculate a number of positions at point 62 in FIG. 13, comprising:

i. Stop position: this is used in 'fixed thickness mode', and is defined as the bottom-of-die reference position minus the target thickness set at stage 55;
ii. Compaction speed position: this is the position at which the punch switches from full speed movement to compaction speed, as set in stage 55 above, and is defined as a predetermined distance above or below the top of the die, such as for example 5 mm below the top of the die in this example;
iii. Return position: The position the punch returns to after the compaction, defined as a predetermined distance above or below the top of the die, such as for example 2 mm above the top of the die in this example.

At 64, a tablet description (identifier) can be input by the user via the PC interface. This is shown on exported reports.

The determined parameters are sent back to the PC by the tablet press firmware at 66, along with an indication that the compaction is starting.

The firmware then controls operation of the motor 28,214 in conjunction with the digital encoder such that the punch 24 moves downwards at full speed until the compaction speed position (as calculated at stage 62) is reached. This position is determined by control loop 68, at which point the firmware controls the change in operation of the motor 28 to operate the punch at the compaction speed, which is constant for the compaction phase of the process.

At 70 the punch 24 continues its downward movement such that it comes into contact with powder in the die. The change to compaction speed also triggers a signal from the tablet press to the PC such that the PC software will start plotting a graph of load against position for the punch. The load reading is taken from the load cell 26 and/or 238 and the position is determined by the angular position of the motor in accordance with the digital encoder.

Further downward movement of the punch compacts the powder in the die until either: the required position (calculated in (i) above) is reached 74*a*, when in the 'fixed thickness' mode; or, the required load (set in b above) is reached 74*b*, when in the 'fixed load' mode. In either mode, the compaction will be aborted if the load cell is overloaded.

The punch then stops. The punch may be held for a predetermined period at this position. In particular, the user may provide a desired dwell time at 75 for a particular operation of the tablet press. The dwell time may be input as an absolute value, or as a function of the set compaction speed.

The ability to control the dwell time of the tablet press 10 is significant because different mass production tabletting machines will hold the powder under compression for different lengths of time during a tablet forming operation, and it is important that the tablet press 10 of the present invention can simulate the operation of various different mass production machines. Furthermore, typical mass production machines operate in such a way that the compaction speed of the punches and their dwell time (the time while the powder is held under maximum compression) will vary with the speed of the machine. The invention allows for the dwell time to be similarly varied along with the compaction speed to simulate the operation of such machines. This all improves the capability of the tablet press 10 to accurately predict how a particular powder will behave in real world applications. For example, tests may show that a particular powder performs only if the dwell time is sufficiently large. This information could be used to provide a list of recommended tabletting machines and/or maximum operational speeds for manufacture.

When the dwell time at 75 is reached, the motor is controlled to retract the punch at compaction speed for a predetermined distance, such as, for example 2 mm. Graph plotting then ends. The motor then actuates the punch in the retraction direct at full speed to the datum position at 76.

The user is given the option to eject the tablet from the die at 78. If this is manually declined by the user, the routine ends and the firmware returns to a ready condition for a further compaction.

During ejection, the punch initially runs downward at full speed at stage 80, until the compaction speed position is reached. The punch then continues at compaction speed at stage 82. This motor control sequence is similar to that of the compaction itself and is not repeated here for conciseness.

The ejection process continues until the controller determines that the punch end 25 has reached the location of the bottom of the die (i.e. the location at which the floor member 40 was previously present). Once the bottom of the die is reached, the punch reverses to the return position. During the ejection process the load cell 26 and/or 238 may continue to measure the forces in order to determine the ejection force of a tablet. Similar assessments can be made during the process of moving the floor member 40 if this step is performed using the punch 24 of the tablet press.

The tablet press and associated firmware now return to a ready condition in which the tablet press is able to start the next compaction, or for settings to be altered.

Whilst the above embodiments make use of both on-board firmware and external computer software, it is to be noted that the tablet pressing process can be carried out entirely under the control of the machine firmware if necessary. The user may enter the necessary data using the keys 34 in response to simple prompts on display screen 32. However, it is felt that the combined use of basic firmware and more advanced software running on a connected computer offers useful functionality that would otherwise add expense to a stand-alone tablet press device. However, any, or any combination, of on-board and remote or external data processing is envisaged as being possible based on the foregoing description. Any reference to a 'controller' herein may refer to one or more processors arranged either onboard the tablet press or in communication therewith to achieve the desired control function.

Figure 13:
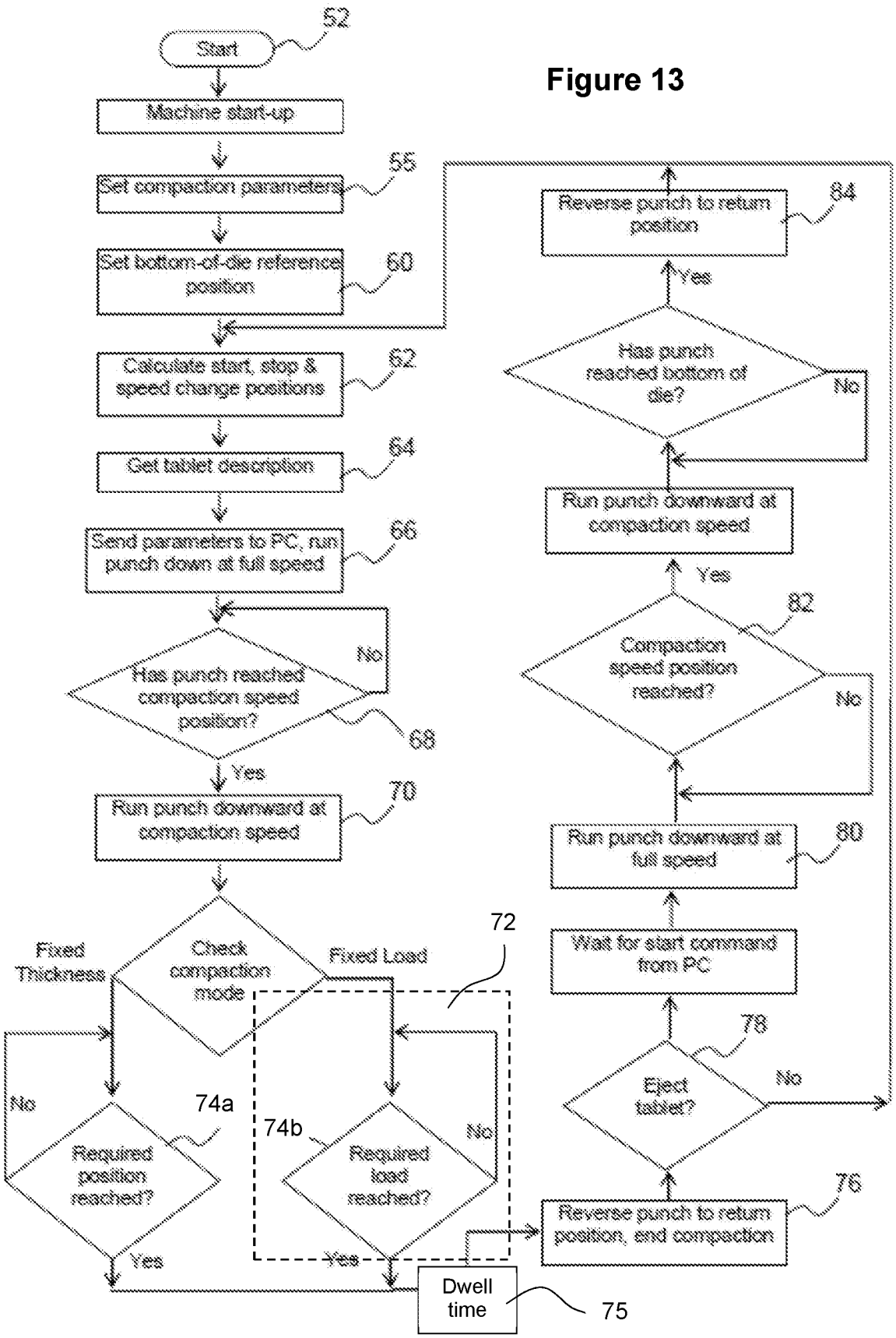
FIG. 13 shows a flow diagram of tablet press operation according to one embodiment of the invention.

FIG. 13 shows only an overview of the 'fixed load' compaction mode in the region designated 72. The additional control steps provided when the tablet press 10 is operating in the 'fixed load' mode allow for a pause to be provided within a compression operation and for a change in compaction speed, and are illustrated in FIG. 14.

At 86 the controller checks if the user has set an intermediate load value for the compaction operation, and if so the controller checks to see if this load has been reached at 88. Once the limit has been reached, movement of the punch 24 is stopped/paused for a time period 90. After this pause, the controller goes on to check, at 92, whether or not a second compaction speed, which may be higher or lower than the compaction speed of step 70, is required to complete the compaction operation. The punch is then moved downwards again, at the desired compaction speed, until the required load at 74*b* is reached as described in relation to FIG. 13.

The invention also relies on motor control to hold the punch 24 stationary during the pause 90 and/or dwell time 75. In either case the motor remains energised, but set at zero speed, to provide a braking force and avoid the punch 24 moving under the force from the compressed powder/tablet. This can be achieved by, for example, by shorting the two ends of the motor winding together. This type of control reduces overrun/coasting of the motor to a stop, so allows the motor to be stopped quickly as well as ensuring that the resulting static position can be precisely maintained.

Figure 14:
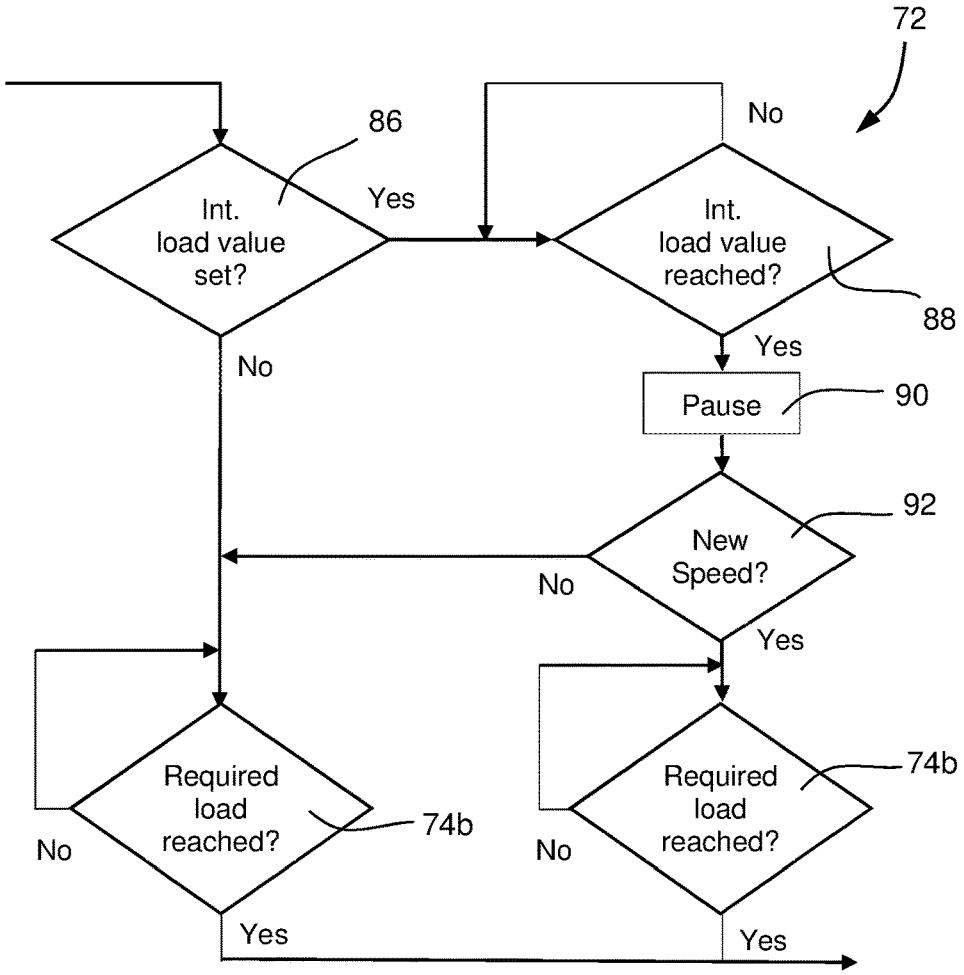
FIG. 14 shows a flow diagram providing detail from a section of the flow diagram of FIG. 13.
Figure 15:
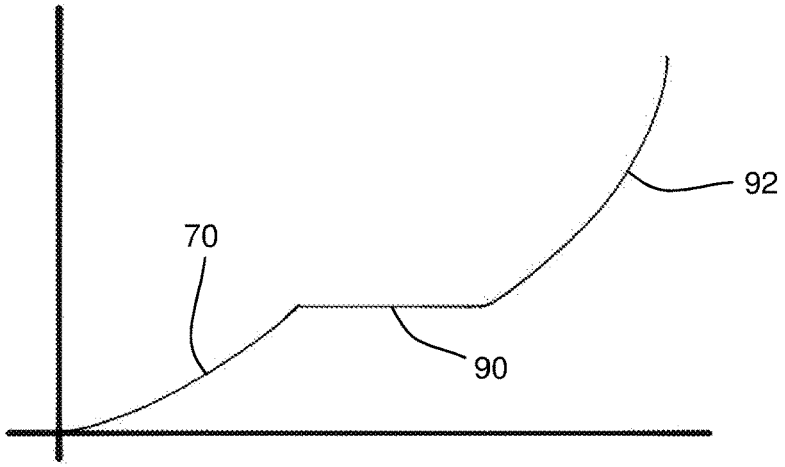
FIG. 15 shows an example plot of a compaction operation.

An example of a compression profile which can be achieved using the control of FIG. 14 is shown in FIG. 15. In the illustrated example, a compression is initially performed at a first compaction speed 70, paused for a set time 90, and then continued at a second, faster, compaction speed 92. As previously noted, the interactions within powders during are complex, and the tablet press of the invention will often be used with new or bespoke compositions. Including a pause during the formation of a tablet, can beneficially provide a time for powder to settle after an initial load has been applied, but before full compaction is achieved.

For example, a predetermined change of speed can allow the initial compaction to be performed more gently, if a known composition requires, before the main compaction is performed more quickly to minimise production time. Alternatively, the initial compaction may be performed quickly, to settle the powder before a more gentle main compaction is used. In either case, the duration of the pause can be set at any desired value, including zero.

Alternatively, the second compaction speed and/or the duration of the pause may be determined using feedback from the load cell 26 and/or 238 once the intermediate limit value 88 has been reached. The reaction forces from a column of powder may change as the partly compacted powder is held static under pressure, possibly as a result of particles settling or moving, or because of the absence of dynamic friction. By pausing the compaction and continuing to monitor the readings from the load cell 26 and/or 238 important information about the behaviour of a particular powder, can be determined and, if appropriate, the remainder of the compaction operation can be automatically modified. This is of particular use when working with an unknown bespoke powder composition for the first time. For example, a first compaction speed can be set based on a suspected similar composition, and a relatively low intermediate load could be set. The behaviour of the composition can then be compared with that of the known composition under equivalent conditions to determine whether or not the compaction speed is appropriate for the new composition or should be changed.

It should be understood that the control features discussed above allow for a great deal of control over the compaction operation. The mechanism of the tablet press 10 and the operation of the motor described above also help to ensure that accurate and precise control of the movement of the punch 24 is achievable, simply through motor control, and that the various limit values or positions can be achieved and held precisely.

The invention claimed is:

1. A tablet press comprising:

a base;

a die assembly mounted on an upper surface of the base;

a compaction mechanism extending from within the base to a location above the die assembly;

a press member mounted on the compaction mechanism above the die assembly for compacting powder received, in use, within the die assembly;

a load cell mounted between the press member and the compaction mechanism for determining the load applied, during use, by the press member;

an electric motor engaged with the compaction mechanism to drive the compaction mechanism vertically relative to the base;

a second load cell located below the die assembly and extending upward from the base; and a controller to control the speed and direction of the electric motor to move the press member between a predetermined position and at least one further position.

2. The tablet press of claim 1, wherein the die assembly comprises a die floor with a vertically movable portion which rests, in use, on top of the second load cell.

3. The tablet press of claim 2, wherein the die floor comprises a slider block with an opening spaced from the vertically movable portion such that the die floor can be moved to position either the opening or the vertically movable portion beneath a chamber of the die.

4. The tablet press of claim 2, wherein the vertically movable portion comprises a disc, held in place within the remainder of the die floor by a ball spring screw.

5. The tablet press of claim 1, wherein at least one further position of the press member is determined based on the detection of a pre-set load by the second load cell.

6. The tablet press of claim 1, wherein the controller monitors a limit value during a compaction operation and stops the motor to hold the mechanism at a fixed location for a defined period of time when the limit value is reached.

7. A tablet press comprising:

a base;

a die assembly mounted on an upper surface of the base;

a compaction mechanism extending from within the base to a location above the die assembly;

a press member mounted on the compaction mechanism above the die assembly for compacting powder received, in use, within the die assembly;

a load cell mounted between the press member and the compaction mechanism for determining the load applied, during use, by the press member;

an electric motor engaged with the compaction mechanism to drive the compaction mechanism vertically relative to the base; and a controller to control the speed and direction of the electric motor to move the press member between a predetermined position and at least one further position, wherein the controller monitors a limit value during a compaction operation and stops the motor to hold the mechanism at a fixed location for a defined period of time when the limit value is reached, wherein the period of time is a function of the speed of the motor during the compaction operation.

8. The tablet press of claim 7, wherein the limit value is a position of the press indicative of the end of a desired compaction operation.

9. The tablet press of claim 7, wherein the limit value is a desired pressure at the end of a desired compaction operation.

10. The tablet press of claim 7, wherein the limit value is a desired intermediate value during a desired compaction operation, and wherein the controller is configured to re-start the compaction operation after the period of time.

11. The tablet press of claim 10, wherein the controller is configured to re-start the compaction operation with the motor running at a second, different, speed.

12. The tablet press of claim 11, wherein the second speed is pre-set by a user prior to the compaction operation.

13. The tablet press of claim 11, wherein the second speed is determined based on load cell readings and positional information monitored during the time period.

14. The tablet press of claim 7, wherein the motor is stopped by the controller maintaining the motor in an energised state with the motor speed set to zero.

15. A pivotally mounted die assembly, for a linearly operating tablet press, and comprising a pivoting part mounted at a pivot to a supporting frame;

the pivoting part comprising a die assembly with a chamber for forming a tablet;

the chamber having an open end for receiving a linearly operating punch of the tablet press along an axis extending through the chamber, and a sliding floor component opposite the open end; and the sliding floor component being movable substantially at right angles to the axis between first and second positions;

wherein restraining means are provided to selectively stop rotation of the pivoting part at first and second defined angular positions relative to the supporting frame.

16. The pivotally mounted die assembly of claim 15, wherein the restraining means comprises a fixed stop provided on the supporting frame.

17. The pivotally mounted die assembly of claim 16, wherein the fixed stop comprises two abutment surfaces for abutment with the pivoting part.

18. The pivotally mounted die assembly of claim 16, wherein the restraining means further comprises at least one selectively engageable stop member.

19. The pivotally mounted die assembly of claim 18, wherein the at least one selectively engageable stop member is provided on the supporting frame.

20. The pivotally mounted die assembly of claim 19, wherein the at least one selectively engageable stop member comprises a blocking portion which is movable between a disengaged position and an engaged position.

21. The pivotally mounted die assembly of claim 20, wherein the at least one selectively engageable stop member comprises a lever joined to the blocking portion for actuating the blocking portion.

22. The pivotally mounted die assembly of claim 20, wherein the blocking portion of the at least one selectively engageable stop member, in its engaged position, provides an abutment surface such that the pivoting part of the assembly can be held between the fixed stop and the blocking part of a selectively engageable stop member.

23. The pivotally mounted die assembly of claim 19, wherein at least one notch for receiving the blocking part of a selectively engageable stop member is provided on the pivoting part.

24. The pivotally mounted die assembly of claim 23, wherein the engagement of said blocking part with the at least one notch holds the pivoting part at a further defined angular position.

25. The pivotally mounted die assembly of claim 18, wherein only a single selectively engageable stop member is provided.

26. The pivotally mounted die assembly of claim 15, wherein the restraining means comprises a stepper motor controlled to hold the pivoting part at said first and second defined angular positions.

27. The pivotally mounted die assembly of claim 15, wherein the stepper motor is additionally controlled to hold the pivoting part in at least one further angular position.

28. The pivotally mounted die assembly of claim 24, wherein the at least one further angular position is between said first and second angular positions.

29. The pivotally mounted die assembly of claim 15, wherein the first and second angular positions are spaced apart by 90°.

30. The pivotally mounted die assembly of claim 15, wherein the pivot between the pivoting part and the supporting frame intersects with the axis extending through the chamber, and with the sliding floor component.

31. The pivotally mounted die assembly of claim 15, wherein the pivoting part comprises a sloping floor or channel along which a tablet formed in the chamber can pass.

32. The pivotally mounted die assembly of claim 15, wherein the sliding floor component comprises an opening which is offset from the chamber when the sliding floor component is in its first position and is aligned with the chamber when the sliding floor component is in its second position.

33. The pivotally mounted die assembly of claim 31, wherein the sliding floor component comprises the sloping floor or channel.

34. The pivotally mounted die assembly of claim 15, wherein the die assembly is permanently fixed via the pivot to the supporting frame.

35. The pivotally mounted die assembly of claim 15, wherein the pivoting part comprises a mounting part for receiving the die assembly.

36. A pivoting die mounting apparatus for mounting a die assembly from a linearly operating tablet press, the die mounting apparatus comprising a supporting frame and a pivoting part, for receiving the die assembly, mounted at a pivot to the supporting frame;

the pivoting part being open at one end so as not to obstruct access to an end of the die assembly;

wherein restraining means are provided to selectively stop rotation of the pivoting part at first and second defined angular positions relative to the supporting frame.

37. The pivoting die mounting apparatus of claim 36, wherein the restraining means comprises a fixed stop provided on the supporting frame.

38. The pivoting die mounting apparatus of claim 37, wherein the fixed stop comprises two abutment surfaces for abutment with the pivoting part.

39. The pivoting die mounting apparatus of claim 36, wherein the restraining means further comprises at least one selectively engageable stop member.

40. The pivoting die mounting apparatus of claim 39, wherein the at least one selectively engageable stop member is provided on the supporting frame.

41. The pivoting die mounting apparatus of claim 40, wherein the at least one selectively engageable stop member comprises a blocking portion which is movable between a disengaged position and an engaged position.

42. The pivoting die mounting apparatus of claim 41, wherein the at least one selectively engageable stop member comprises a lever joined to the blocking portion for actuating the blocking portion.

43. The pivoting die mounting apparatus of claim 41, wherein the blocking portion of the at least one selectively engageable stop member, in its engaged position, provides an abutment surface such that the pivoting part of the apparatus can be held between the fixed stop and the blocking part of a selectively engageable stop member.

44. The pivoting die mounting apparatus of claim 40, wherein at least one notch for receiving the blocking part of a selectively engageable stop member is provided on the pivoting part.

45. The pivoting die mounting apparatus of claim 44, wherein the engagement of said blocking part with the least one notch holds the pivoting part at a further defined angular position.

46. The pivotally mounted die assembly of claim 39, wherein only a single selectively engageable stop member is provided.

47. The pivoting die mounting apparatus of claim 36, wherein the restraining means comprises a stepper motor controlled to hold the pivoting part at said first and second defined angular positions.

48. The pivoting die mounting apparatus of claim 47, wherein the stepper motor is additionally controlled to hold the pivoting part in at least one further angular position.

49. The pivoting die mounting apparatus according to of claim 45, wherein the at least one further angular position is between said first and second angular positions.

50. The pivoting die mounting apparatus of claim 36, wherein the first and second angular positions are spaced apart by 90°.

51. The pivoting die mounting apparatus of claim 36, wherein the pivoting part comprises a sloping floor or channel along which a tablet can pass.

52. A method of forming a tablet using a linearly operating tablet press and a die assembly with a tablet forming chamber comprising an open end for receiving a linearly operating punch of the tablet press, and a sliding floor component opposite the open end;

the method comprising, in sequence, the steps of:

A) actuating the punch of the tablet press to compress the powder contained in the chamber against the sliding floor component;

B) withdrawing the punch from the chamber;

C) rotating the die assembly from a first set angular position to a second set angular position; and D) actuating the punch of the tablet press to move the sliding floor component from a first position to a second position.

53. The method of claim 52, comprising the additional steps of:

E) rotating the die assembly from said second set angular position to said first set angular position; and F) actuating the punch of the tablet press to eject a tablet from the chamber;

wherein steps E) and F) are performed in sequence after step D).

54. The method of claim 53, comprising the additional steps of:

G) rotating the die assembly to a third angular position; and

H) placing powder into the open end of the tablet forming chamber;

wherein steps G) and H) are performed in sequence before step A).

55. The method of claim 54 wherein the third angular position is between the first and second angular positions.

56. The method of claim 52, wherein the first and second angular positions are spaced apart by 90°.

57. The method of claim 52, performed using a pivotally mounted die assembly comprising a pivoting part mounted at a pivot to a supporting frame; the pivoting part comprising a die assembly with a chamber for forming a tablet; the chamber having an open end for receiving a linearly operating punch of the tablet press along an axis extending through the chamber, and a sliding floor component opposite the open end; and the sliding floor component being movable substantially at right angles to the axis between first and second positions; wherein restraining means are provided to selectively stop rotation of the pivoting part at first and second defined angular positions relative to the supporting frame.

58. The method of claim 52, performed using a pivoting die mounting apparatus comprising a supporting frame and a pivoting part, for receiving the die assembly, mounted at a pivot to the supporting frame; the pivoting part being open at one end so as not to obstruct access to an end of the die assembly; wherein restraining means are provided to selectively stop rotation of the pivoting part at first and second defined angular positions relative to the supporting frame and a die assembly comprising a tablet forming chamber having an open end for receiving a linearly operating punch of the tablet press and a sliding floor component opposite the open end.

* * * * *